US007963839B2

(12) United States Patent
Gatto et al.

(10) Patent No.: US 7,963,839 B2
(45) Date of Patent: Jun. 21, 2011

(54) REGULATED GAMING EXCHANGE

(75) Inventors: Jean-Marie Gatto, London (GB); Thierry Brunet De Courssou, Henderson, NV (US)

(73) Assignee: Mudalla Technology, Inc., Palo Alto, CA (US)

( * ) Notice: Subject to any disclaimer, the term of this patent is extended or adjusted under 35 U.S.C. 154(b) by 636 days.

(21) Appl. No.: 11/533,295

(22) Filed: Sep. 19, 2006

(65) Prior Publication Data

US 2008/0070666 A1 Mar. 20, 2008

(51) Int. Cl.
*A63F 9/00* (2006.01)

(52) U.S. Cl. ..... 463/16; 463/25; 463/29; 463/30; 463/42; 463/43

(58) Field of Classification Search ..... 463/16, 463/25, 29, 40, 42, 43, 30
See application file for complete search history.

(56) References Cited

U.S. PATENT DOCUMENTS

| | | | |
|---|---|---|---|
| 4,593,904 | A | 6/1986 | Graves |
| 4,695,053 | A | 9/1987 | Vazquez, Jr. et al. |
| 5,342,049 | A | 8/1994 | Wichinsky et al. |
| 5,823,873 | A | 10/1998 | Moody |
| 6,012,983 | A | 1/2000 | Walker et al. |
| 6,019,374 | A | 2/2000 | Breeding |
| 6,050,895 | A | 4/2000 | Luciano, Jr. et al. |
| 6,077,163 | A | 6/2000 | Walker et al. |
| 6,244,957 | B1 | 6/2001 | Walker et al. |
| 6,267,669 | B1 | 7/2001 | Luciano, Jr. et al. |
| 6,283,474 | B1 | 9/2001 | de Keller |
| 6,409,597 | B1 | 6/2002 | Mizumoto |
| 6,508,709 | B1 | 1/2003 | Karmarkar |
| 6,517,433 | B2 | 2/2003 | Loose et al. |
| 6,522,312 | B2 | 2/2003 | Ohshima et al. |
| 6,551,187 | B1 | 4/2003 | Jaffe |
| 6,645,075 | B1 | 11/2003 | Gatto et al. |
| 6,674,448 | B1 | 1/2004 | Garahi et al. |
| 6,761,632 | B2 | 7/2004 | Bansemer et al. |
| 6,811,482 | B2 | 11/2004 | Letovsky |
| 6,862,696 | B1 | 3/2005 | Voas et al. |
| 6,908,391 | B2 | 6/2005 | Gatto et al. |
| 6,916,244 | B2 | 7/2005 | Gatto et al. |
| 6,916,247 | B2 | 7/2005 | Gatto et al. |

(Continued)

OTHER PUBLICATIONS

Wikipedia, the free encyclopedia. Online Poker. Accessed May 8, 2009.*

(Continued)

*Primary Examiner* — Dmitry Suhol
*Assistant Examiner* — Andrew Kim
(74) *Attorney, Agent, or Firm* — Young Law Firm, P.C.

(57) ABSTRACT

System architecture and methods for enabling (a) freelance game developers gather intelligence data such as to offer dazzling electronic games to the regulated casino gaming marketplace and receive compensation based on the success of their games, and (b) game operators gather intelligence data to enables them to tailor their regulated game offerings. Intelligence data for both the freelance game developers and the game operators are based on demand/popularity of identical trial games available to the public over a predetermined computer site, the trial games using simulated money only. In addition, players are provided with the location of the casinos offering their favorite game(s) for playing with real money, together with the promotions offered if any. Operators are provided with the contacts of the players and their list of favorite games such as to offer incentives to attract them to their casino.

133 Claims, 16 Drawing Sheets

U.S. PATENT DOCUMENTS

| | | | | |
|---|---|---|---|---|
| 6,945,870 | B2 | 9/2005 | Gatto et al. | |
| 2001/0031656 | A1 | 10/2001 | Marshall et al. | |
| 2002/0147040 | A1 | 10/2002 | Walker et al. | |
| 2003/0078101 | A1 | 4/2003 | Schneider et al. | |
| 2003/0100369 | A1 | 5/2003 | Gatto et al. | |
| 2003/0211881 | A1 | 11/2003 | Walker et al. | |
| 2004/0087357 | A1* | 5/2004 | Johnson | 463/17 |
| 2004/0102238 | A1 | 5/2004 | Taylor | |
| 2004/0198496 | A1 | 10/2004 | Gatto et al. | |
| 2005/0114774 | A1 | 5/2005 | Berryman | |
| 2005/0282637 | A1 | 12/2005 | Gatto et al. | |
| 2006/0100010 | A1 | 5/2006 | Gatto et al. | |
| 2008/0032794 | A1 | 2/2008 | Ware | |

OTHER PUBLICATIONS

"Interactive Solutions(TM) Corporation and BestBetTV.com Announce Strategic Non-Wagering 'Play-for-Fun' Gaming Alliance." PR Newswire. PR Newswire Association LLC. 2001. HighBeam Research. Sep. 11, 2010 <http://www.highbeam.com>.*

International Search Report and Written Opinion of the International Searching Authority of Sep. 19, 2008 in corresponding PCT Application PCT/US07/75529 (6 pages).

"User-Generated Future for Gaming", By Tayfun King, Reporter, BBC Click, published May 19, 2006 16:17:49 GMT, at http://news.bbc.co/uk/go/pr/fr/-/2/hr/programmes/click_online/5997036.stm (2 pages).

International Search Report of Sep. 23, 2008 in related PCT application PCT/US07/75528.

Written Opinion of Sep. 23, 2008 in related PCT application PCT/US07/75528.

Gamasutra, "Breaking: Microsoft to enable user-create games", Aug. 14, 2006, http://www.gamasutra.com/php-bin/news_index.php?story=10458, printed Sep. 6, 2006 (2pgs).

Microsoft Corporation, "What is Photosynth?", http://labs.live.com/photosynth/whatis/default.html, printed Aug. 9, 2006 (7pgs).

CNN.com, "Microsoft: Create your own video game", http://cnn.worldnews.printthis.clickability.com/pt/cp? action=cp&title=CNN.com+-+Micr..., printed Aug. 16, 2006 (2pgs).

"Microsoft invites the world to create its own xbox 360 console games for the first time" (2pgs).

Darryl K. Taft, eWeek Enterprise News & Reviews, "Microsoft playing games with developers", http://www.eweek.com/ print_article2/0,1217,a=185993,00.asp, printed Aug. 16, 2006 (3pgs).

The Associated Press, ENTmag.com News, "Microsoft to sell video game development software", http://entmag.com/news/print.asp?EditorialD-7700, printed Aug. 16, 2006 (2pgs).

Wikipedia, "Sandbox (computer security)", http://en.wikipedia.org/wiki/Sandbox_%28computer_security%29, printed Aug. 10, 2006 (1pg).

Wikipedia, "Sandbox (software development)", http://en.wikipedia.org/wiki/Sandbox_%28software_development%29, printed Aug. 10, 2006 (2pgs).

Microsoft Corporation, MSDN, XNA Frequently Asked Questions, "XNA Framework and XNA Game Studio Express Frequently Asked Questions", http://msdn.microsoft.com/direct/xna/faq/Default.aspx?print=true, printed Sep. 6, 2006 (5pgs).

International Preliminary Report on Patentability and Written Opinion of the International Searching Authority in related PCT application PCT/US2007/075523.

Office Action mailed Sep. 21, 2010 in related U.S. Appl. No. 11/533,287.

* cited by examiner

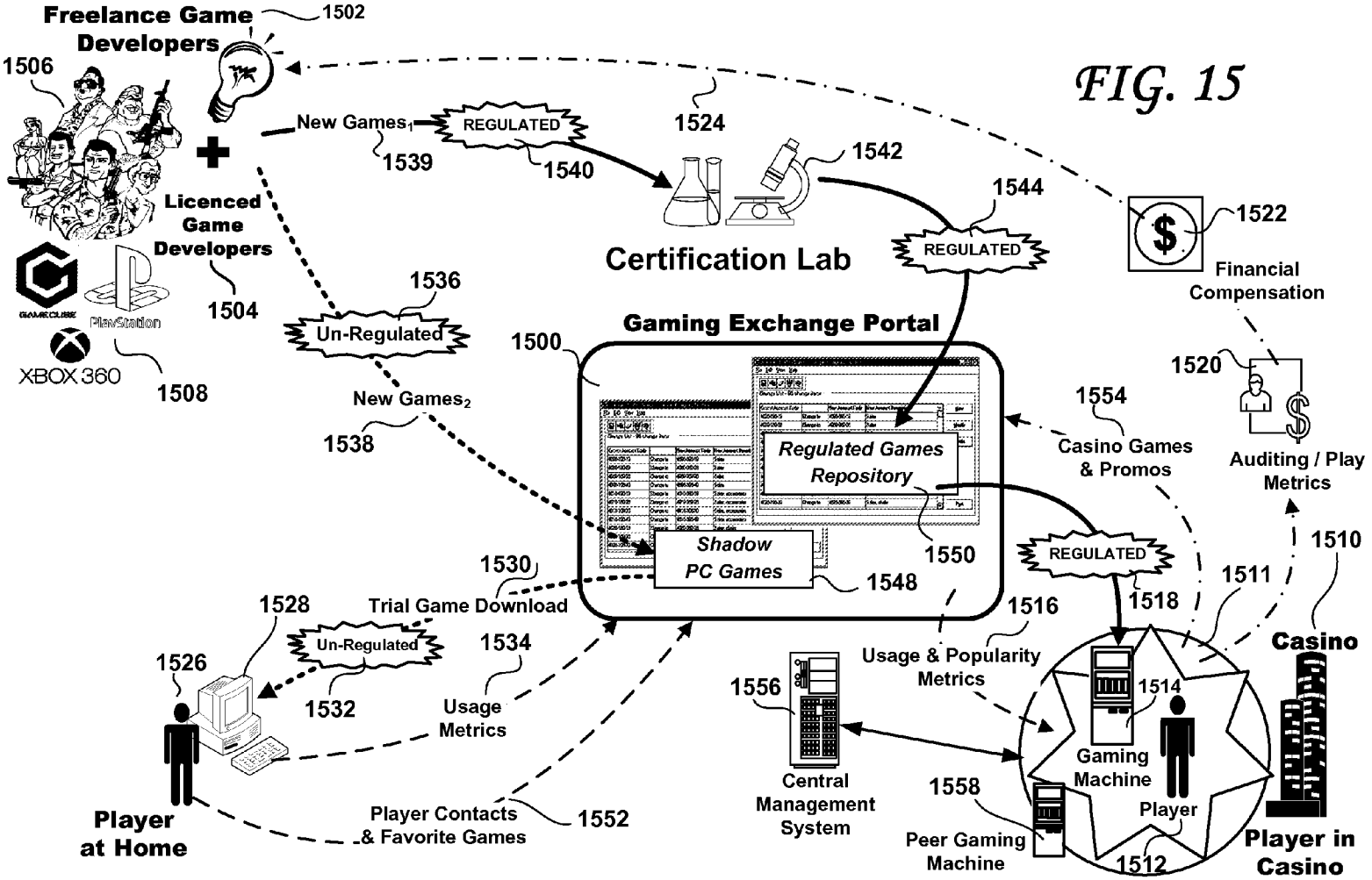
FIG. 15
Freelance Game Developers
1502
1506
Licenced Game Developers
1504
1508
XBOX 360
New Games1
1539
REGULATED
1540
1524
Certification Lab
1542
REGULATED
1544
Un-Regulated
1536
New Games2
1538
Gaming Exchange Portal
1500
Regulated Games Repository
1550
Shadow PC Games
1548
Financial Compensation
1522
1520
Auditing / Play Metrics
Casino Games & Promos
1554
REGULATED
1518
Casino
1510
1511
Gaming Machine
1514
Player
1512
Player in Casino
Usage & Popularity Metrics
1516
Peer Gaming Machine
1558
Central Management System
1556
Trial Game Download
1530
Un-Regulated
1532
Usage Metrics
1534
1528
1526
Player at Home
Player Contacts & Favorite Games
1552

REGULATED GAMING EXCHANGE

BACKGROUND OF THE INVENTION

Copyright Notice/Permission

A portion of the disclosure of this patent document contains material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings referred to herein: Copyright 2006, Cyberscan Technology, Inc., All Rights Reserved.

CROSS-REFERENCE TO RELATED CASES

The subject matter of the present application is related to the subject matter of commonly assigned and co-pending patent application entitled "Regulated Gaming—Compartmented Freelance Code," Atty. Docket No. CYBS6004A and is also related to the subject matter of commonly assigned and co-pending patent application entitled "Regulated Virtual Display," Atty. Docket No. CYBS6004B, each application of which is being filed on even date herewith.

FIELD OF THE INVENTION

This invention relates generally to the field of regulated pay computer-controlled games, either games of skills or games of chance and more particularly to the field of integrating, certifying and downloading games developed by multi-parties and of building relationships between players and game operators to promote the games.

DESCRIPTION OF THE PRIOR ART AND RELATED INFORMATION

Presently game regulation essentially considers a slot machine as a standalone piece of equipment supplied entirely by a single vendor (e.g. IGT, WMS, Bally). Although standards now allow for some vendor interoperability between peripheral devices (e.g. hopper, bill accepter, ticket printer) and a central accounting system (e.g. IGT/GSA SAS Standard Accounting System protocol), a slot machine as delivered comprises essentially proprietary components developed and manufactured by a single supplier. In particular, game regulators have made no attempt to adapt their standards to enable the suppliers to leverage on the extraordinary multimedia capabilities of the PC platform and the advances in distributed network security. Consequently, the operating system and game software controlling a slot machine are proprietary and almost entirely developed by the supplier's software programmers, such as to meet regulatory requirements that are out of sync with main stream computing. It is worrying to see that current gaming regulation leaves no choice to the suppliers but to modify the source code of their operating system (e.g. Linux). This prevents them from continually benefiting from security peer review and from associated security upgrades developed by operating system experts. Consequently, the operating system of such gaming machines is considerably weakened and fractured, exposing the suppliers and game operators to stealth and focused hacking attacks.

It is reasonable to believe that sooner or later the standards formulated by the Trusted Computer Group (TCG) to secure distributed computer network will be adopted by game regulators. Therefore, well architectured and security-hardened commercial multimedia operating systems may be used by slot machine vendors, without needing to hack the kernel source code.

As an immediate result of adopting industry security standards, the vendors may allocate more resources to develop more attractive games and enable their download from a central system. However, present game regulation is such that the entire game software may only be developed by the slot supplier himself, thus significantly impeding suppliers from offering games inspired or derived from the best-of-breed and phenomenally popular game titles available on Xbox and PlayStation, or other games developed by freelance game developers. It is unlikely that the culture inside a slot manufacturer's game software engineering department would ever attract creative minds to create games on par with what is and will be available in the main stream gaming arena.

The path for freelance game development companies that would be looking at introducing their games and game technologies into the highly regulated casino marketplace has traditionally been a narrow and tortuous one. Historically, such companies have held only three real options: (a) to partner with an established casino game manufacturer such as IGT, Bally or WMS, (b) to sell their designs to an established game manufacturer, or (c) to attempt to create their own casino game manufacturing company. All of these paths are difficult to tread. For example, large legacy gaming companies have their own game creation studio, fully staffed with trained artists and trained software developers. As such, they are generally reluctant to introduce truly visionary game designs into their gaming libraries, as they have achieved a longstanding history of profitability with more conservative games revolving essentially around boring fruit-machine-like games, poker games and secondary games such as Wheel of Fortune and Mystery Jackpot.

A further limitation of the existing casino gaming marketplace is that game developers looking to start their own casino game manufacturing companies face several key obstacles, the most important of which being the lengthy and prohibitively expensive regulatory process that must be navigated to gain even a precarious foothold in the casino gaming market.

Most of all and sadly enough, there is no dialog between the game regulators and innovative gaming companies that would otherwise enter the regulated gaming market. This is because such innovative gaming companies most often do not have the coveted game license, which is required in every state. Therefore, promising freelance game development companies (such as those developing dazzling games for console-type platforms such as the Xbox and PlayStation for example or those developing PC-based games) that would be looking at introducing variants of their games into the highly regulated casino marketplace are, in effect, completely shut out. Indeed, the dazzling graphics rendered in such games rely upon constantly evolving PC and game console hardware and software technologies, including operating systems such as Microsoft Windows XP and forthcoming Vista. To their defense, the attitude of gaming regulators is understandable, as these game technologies are not well adapted for the highly regulated gaming environment, mainly because of security issues.

The Gaming Standard Association (GSA) is not helping the situation as it is formed by members that are in majority representatives of the influential established casino game manufacturers that have little interest in changing whatsoever. The gaming certification labs that are subcontracted by equipment suppliers to test and certify that their equipment meets applicable game regulation do indeed set gaming standards. These gaming certification labs also do not attempt to assume a leadership role to adapt their standards to lay the foundations on which new computer technologies could meet the security standards for the regulated gaming market. For these reasons, the progress that has been achieved in general computer security has gone largely unnoticed and innovative gaming companies are still barred from offering innovative gaming technologies. The legacy game manufacturers' stranglehold on casino gaming has excluded visionary game designers from fully participating in this market and has prevented game operators from offering the public the best possible games.

SUMMARY OF THE INVENTION

In is an object of the present invention to enable freelance game developers to offer dazzling electronic games to the regulated casino gaming marketplace. It is another object of the present invention to ensure that the freelance game developers receive compensation that is commensurate with the success of their games. A still further object of the present invention is to provide game operators with timely information to enable them to tailor their regulated game offerings based on demand and/or popularity of identical trial games that use only simulated money and that are made available to the public over an Internet portal. It is a further object of the present invention to provide players with the location of the casinos offering their favorite game(s) for playing with real money, together with the promotions offered if any. It is yet another object of the present invention to provide game operators with the contact information of the players and their list of favorite trial games, to enable them to offer incentives and to attract them to their casino. Another object of the present invention is to offer freelance game developers a method for developing, integrating licensing tags, testing and certifying secure downloadable electronic games, such that an unprecedented generation of advanced electronic games may be offered to players in casinos on a relatively short timetable.

It is another object of the invention to offer players, operators, licensed developers and freelance developers search means to query the regulated gaming exchange and obtain results structured according to the formulated query and related results (popularity ratings, most often requested queries, general promotional offers and specifically targeted promotional offers, for example).

In is another object of the present invention to offer the freelance game developers a compartmented architecture for developing, integrating licensing tags, testing and certifying secure downloadable electronic games such that an unprecedented generation of dazzling electronic games may be offered to players in regulated gaming places on a relatively short timetable. In is a further object of the present invention to ensure that the freelance game developers receive compensation based on the success of their games.

Accordingly, an embodiment of the present invention is compartmented system architecture and associated methods for enabling freelance game developers to (a) integrate their game software together with the gaming manufacturer software and (b) tag their software such as to receive compensation based on the success of their games. The combined tagged freelance software and gaming manufacturer software may rapidly pass through certification testing and be downloaded overnight to a large number of gaming machines such as to offer players in casinos an unprecedented choice of new generation electronic games within a relatively short timetable.

Compartmenting for totally isolating the graphics-rich freelance (and outcome-free) code from the slot supplier (and outcome-determining) code is obtained, according to an embodiment of the present invention, by adopting a blue-screening paradigm wherein the freelance code executes in a process sandbox and renders its entertainment outcome-free graphics in a totally isolated background display plane while the slot supplier code renders its accounting graphics and outcome graphics in a foreground display plane as small graphics gadgets over a neutral plane. The foreground and background display planes are mixed together using the pervasive blue-screening paradigm used in TV studio programs, and foreground moving outcome graphics gadgets are synchronized in real-time with the moving outcome-free background graphics.

Outcome-Free Graphics Background

The entertainment "outcome-free graphics" background (A) and the synchronized moving "outcome graphics gadgets" foreground (B) is best understood using a horse racing game as an example. The horse racing animation may be rendered in a background plane by the freelance code executing in a process sandbox using pre-recorded video or realistic real-time 3D animation. The rendering is such that each horse number indicia usually printed on the horse's saddle blanket is totally obfuscated or otherwise obscured. Consequently, it impossible when watching the rendered horse race to determine which horse is leading and will likely win the race, and what the order of the other horses will be across the finish line. In addition, other features that may help in identifying the horse such as the jockey's jacket color and horse skin color may also be obfuscated. Moreover, the voice-over or sound may not give any indication of the leading horses. Thus, the background plane may constitute a dazzling entertaining scene, complete with realistic sound of hooves and cheering crowds, that is free from any markings (i.e. numbers, colors, shapes) that would reveal or otherwise suggest the outcome of the race.

According to an embodiment of the present invention, the horse (or other race or entrant or team player) number indicia (which gives an indication of the outcome of the game) may be rendered in a foreground plane as graphic gadgets by the certified slot supplier code executing in a process sandbox isolated from the uncertified freelance process running in another sandbox. In addition, according to embodiments of the present invention, the motion, displacement and animation of each graphic gadget is synchronized with the freelance background such that each graphic gadget is rendered over a predetermined target (in the horse race example developed herein, a predetermined horse saddle blanket). The combined background and foreground scene then gives the viewer the capability to identify the leading horses. Similarly, the jockey's jacket colors, horses' true color and other features may be rendered in the same synchronized manner. A game outcome process seeded by a random number generator may provide the graphics gadgets with the random numbers that will be used to render the random indicia on the horse saddle blanket.

Motion Synchronization

The motion synchronization of outcome gadgets over the associated obfuscated area in the outcome-free animation background scene may be carried out, according to embodiments of the present invention, via pre-computed trajectory paths or frame-by-frame. The motion synchronization may utilize, without limitation, one or more of the following technologies and/or methods: a 2D trajectory path, a 3D trajectory path, location, scale, rotation, velocity and/or camera angle, for example. The computer processing and rendering of the outcome-free animation background (e.g. an XBOX or other game console or a PC) may be separate from the slot machine controller (e.g. a PC) processing the game outcome and rendering the outcome gadgets. A dual-ported video-mixer may combine the outcome-free animation background and the outcome graphic gadgets, the motion synchronization being carried out (a) via a suitable direct interface between the two computers using remote procedure call (RPC), Microsoft .NET Remoting (for example) or an IP service, or (b) by real-time image analysis and tracking under the control of the slot machine supplier software using the motion capture paradigm used in cinematography, for example. The dual-ported video-mixer may be a custom ASIC.

Outcome Graphic Gadget Rendering

The graphic gadget may render the horse number and other outcome related features using direct (a) 2D polyline/bezier draw and color fill, (b) triangles and color fill and/or (c) texturing. Path, location, scaling, rotation, 2D projection, illumination sources and other viewing attributes may be provided directly by the freelance software through a secure interface or may be derived from the freelance graphics by motion capture and capture of other scene attributes. Other overlay rendering technique may be used. Rendering of an outcome onto a 2D target is called hereafter a "2D outcome asset."

An embodiment of the invention includes a freelance software that exposes through a secure interface a "neutral" 3D animated geometry (via a surface, NURBS curves or other 3D modeling technique) on which the graphic gadget would project a 3D skin. Rendering of an outcome onto a 3D target is hereafter called a "3D outcome asset." For example, the freelance software may expose a neutral sphere located in space together with scale and rotation attributes, and the graphic gadget may render a skin projection representing the planet earth, the moon, mars, or any other planet as determined by a game outcome. A given planet, in this example, would be 3D asset. Similarly, the freelance software may expose a "cavity" surface located in space together with scale, rotation, etc. . . . in which the gadget may render a 3D fruit such as a cherry, a strawberry, a banana etc., as determined by a game outcome. A given fruit is a 3D asset. Rendering a skin over a surface is commonly practiced in 3D modeling for industrial design (refer to www.rhino3d.com), for example.

Accounting Meters

Other video assets such as the accounting meters may be controlled and rendered by the slot machine supplier software. Interactive video assets having a role in the outcome determination such as wager selections, line selection, chip selection and the bet button may also be controlled and rendered by the slot machine supplier software. Graphic gadgets may be used to render the accounting meters and the interactive video assets, and to activate the interactive video assets.

Space Controller

The rendering of all the animated outcome graphic gadgets may be controlled by a space controller ensuring that they appears at the proper location with the proper viewing attributes for a seamless integration with the dazzling entertainment background.

Playback

For each bet session, the identifiers of all the associated outcome assets together with their paths and viewing attributes as well as the identifier of the background animation may be recorded such that a playback of the complete bet session may be replayed. This may be used for dispute resolution during a player complaint.

Regulatory

The freelance binary code may execute in a process sandbox and may render its entertainment outcome-free graphics in a totally isolated background video plane. The software code that is responsible for producing the game outcome and rendering the game outcome assets is totally under the control of the slot supplier and may not be interfered with by unauthorized processes. Consequently, the freelance code need not be subjected to a full regulatory certification cycle, in which traditionally the entire source code is submitted to the lab, examined, compiled and tested according to stringent test cases. The freelance code may be classified similarly to a commercial operating system that is not subjected to full regulatory certification cycle.

Gaming Exchange

The present Regulated Gaming Exchange or Gaming Exchange Portal enables freelance game developers to offer new and dazzling electronic games to the regulated gaming marketplace and to receive compensation based on the success of their games. The games may be available as an unregulated trial download that allows wagering using only simulated or virtual money. Operators of regulated gaming machines may also download regulated versions of the same games from the Regulated Gaming Exchange for execution on regulated gaming machines. Usage metrics may be collected to determine the popularity of the unregulated trial games. The regulated gaming exchange may include a first repository that is selectively accessible to home players over a computer network, and a second repository that is selectively available over the computer network to operators of regulated gaming machines. The first repository may store an unregulated first version of a game that is configured for game play on a home computing device such as a computer or gaming console, for example. The unregulated first version of the game may be uncertified by a gaming software certification laboratory and may include a first outcome-free game portion and a first outcome-bearing game portion. The unregulated first version of the game is configured, according to embodiments of the present invention, to enable wagering only with virtual money.

The second repository may store a regulated second version of the game that is configured for game play on a regulated gaming machine and that is certified by the gaming software certification laboratory. The regulated second version of the game may include a second outcome-free game portion and a second outcome-bearing game portion. In contrast to the first version of the game, the second version of the game being may be configured to enable wagering with real money. The second outcome-free game portion may be substantially identical to the first outcome-free game portion.

Search Portal

The regulated gaming Exchange portal may include search functionalities, enabling players, freelance developers or game operators to formulate and receive answers for their search queries. A master index of information within the Regulated Gaming Exchange Portal may be generated, to offer search results in a speedy manner. For example, some of the information that may be indexed may include game attributes such as the game type (e.g. fruit type X, poker type Y, etc. . . . ), the game theme (e.g. English, Chinese, Christmas, Easter, Birthday, Marriage, beginner, advanced, etc.), the return to player (RTP) factor (e.g. 92%, 94%, 98%), the denomination (e.g. 1¢, 5¢, 10¢, 50¢, $1, $10, $50) and the volatility (e.g. high, low, medium, that is win small amounts frequently or win larger amounts less often). In addition to usage metrics, the statistics may be kept on the frequency of download for each game and the geographic distribution of such downloads.

Advertising sensing technology may be implemented in the Regulated Gaming Exchange to enable game operators and freelance developers to display relevant ads on their content pages to offer home players an opportunity to follow links to examine casino promotions and freelance full size unregulated version of the games. The history of the queries of each player combined with their usage metrics may be analyzed to derive intelligence therefrom relative to their preferences, to enable the ads and associated links to be tailored to the players.

Accordingly, an embodiment of the present invention is a method of developing and distributing a game. The method may include steps of developing a first outcome-free game portion; developing a first outcome-bearing game portion that is configured to enable waging using only virtual money and that is associated with the developed first outcome-free game portion; merging the first outcome-free game portion and the first outcome-bearing game portion to obtain an unregulated first version of the game; a first making step to make the unregulated first version of the game available for download to at least one home computing device; developing a second outcome-free game portion that is substantially identical to the first outcome-free game portion; developing a second outcome-bearing game portion that is configured to enable wagering using real money and that is associated with the developed second outcome-free game portion; merging the second outcome-free game portion and the second outcome-bearing game portion to obtain a regulated second version of the game to be submitted to a gaming software certification laboratory; obtaining certification of the regulated second version of the game from the gaming software certification laboratory, and a second making step to make the regulated second version of the game available for download into at least one regulated gaming machine.

The obtaining step may be carried out such that source code of the second outcome-free game portion is not submitted to the gaming software certification laboratory. The developing steps may be carried out such that the unregulated first version of the game is configured to not make use of Internet communication and Internet display technologies to execute and play on the home computing device. The developing steps may be carried out such that the first outcome-free portion of the unregulated first version of the game is configured to not make use of Internet communication and Internet display technologies to execute and play on the home computing device. The developing steps may be carried out such that a graphics portion of the unregulated first version of the game is configured to not make use of Internet communication and Internet display technologies to execute and play on the home computing device. The first making step may be carried out such that after the unregulated first version of the game is downloaded to the home computing device, the unregulated first version of the game does not make use of Internet communication and Internet display technologies to execute and play on the home computing device, such Internet communication technologies may include (without limitation) an HTTP Request, an HTTP Reply, a cookie and a Secure Socket Layer (SSL), for example. The Internet display technologies may include (without limitation) an Internet browser, HTML, a Java Scrip, a Java applet, a Scriptlet, an ActiveX control, a plug-in, a pop-up and/or a cookie, for example.

The developing steps may be carried out such that the first outcome-free game portion of the unregulated first version of the game is identical to the second outcome-free game portion of the regulated second version of the game. The developing steps may be carried out such that source code of the first outcome-free game portion of the unregulated first version of the game is substantially identical to source code of the second outcome-free game portion of the regulated second version of the game. The developing steps may be carried out such that source code of the first outcome-free game portion of the unregulated first version of the game is identical to source code of the second outcome-free game portion of the regulated second version of the game. The developing steps may be carried out such that executable code of the first outcome-free game portion of the unregulated first version of the game is substantially identical to executable code of the second outcome-free game portion of the regulated second version of the game. The developing steps may be carried out such that executable code of the first outcome-free game portion of the unregulated first version of the game is identical to executable code of the second outcome-free game portion of the regulated second version of the game.

The first making step may include uploading the unregulated first version of the game into a first repository that is selectively accessible from a predetermined computer site over a computer network and the second making step may include uploading the regulated second version of the game into a second repository that is selectively accessible through the predetermined computer site. The predetermined computer site may include, for example, an Internet portal.

The developing steps may be carried out such that the source of randomization used in the unregulated first version of the game is different than the source of randomization used in the regulated second version of the game. The developing steps may be carried out such that the unregulated first version of the game is configured to store critical meters in a different type of non-volatile storage media than is the regulated second version of the game. The developing steps may be carried out such that the executable code of the unregulated first version of the game is configured to store critical meters in a different type of non-volatile storage media than is the executable code of the regulated second version of the game. The developing steps may be carried out such that the unregulated first version of the game is substantially identical to the regulated second version of the game, except that the regulated second version of the game (a) allows for wagering using real money, (b) uses a certified source of random outcome, (c) stores critical meters on certified non-volatile memory, (d) provides functionality for player dispute resolution and/or (e) communicates with a central game management system. The developing steps may be carried out such that the source code of the unregulated first version of the game is substantially identical to the source code of the regulated second version of the game, except that the source code of the regulated second version of the game (a) allows for wagering using real money, (b) uses a certified source of random outcome, (c) stores critical meters on certified non-volatile memory, (d) provides functionality for player dispute resolution and/or (e) communicates with a central game management system. The developing steps may be carried out such that each software component of the unregulated first version of the game is code-signed with a unique certificate and the home computing device is configured with associated software restriction policies. The developing steps may be carried out such that each software component of the regulated second version of the game is code-signed with a unique certificate and the regulated gaming machine is configured with associated software restriction policies.

The method may further may include a step of receiving usage metrics of game play of the unregulated first version of the game played on the home computing device. The method may also include a step of receiving contact details of a player of the unregulated first version of the game. A step of receiving a preference profile of a player of the unregulated first version of the game may also be carried out. The preference profile of the player of the unregulated first version of the game may be sent to the gaming machine. A step may be carried out of enabling the regulated second version of the game to be configured according to the preference profile. The received usage metrics may be stored on a predetermined computer site and the stored usage metrics may be made available to an operator of the regulated gaming machine, a developer of the regulated second version of the game, a developer of the first and second outcome-free game portions and/or a developer of the unregulated first version of the game, for example. A step may be carried out of the operator of the regulated gaming machine selecting one or more regulated second versions of the game or games for download to one or more regulated gaming machines in accordance with the usage metrics. The method may also include a step of modifying the first outcome-free game portion of the unregulated first version of the game in accordance with the usage metrics. The method may also include a step of sending promotional information to players of the unregulated first version of the game having provided their contact details. A notice of availability of the regulated second version of the game on regulated gaming machines may be sent to players of the unregulated first version of the game. The method may also include a step of making the predetermined computer site accessible to a plurality of operators of regulated gaming machines. The predetermined computer site may also be made accessible to a plurality of freelance game developers. The regulated second version of the game may be made available for download by a plurality of operators of regulated gaming machines from the predetermined computer site. A step may be carried out of enabling uploads of unregulated first versions of games to the predetermined computer site.

The method may also include a step of configuring the predetermined computer site such that the stored usage metrics are selectively available to operators of regulated gaming machines. A step may be carried out of configuring the predetermined computer site such that the stored usage metrics are selectively available to freelance game developers. The predetermined computer site may be configured such that the stored usage metrics are selectively available to players playing on their home computing devices. The home computing device may be, for example, a personal computer (PC), a mobile computer or a game console. The method may also include steps of code signing with a unique certificate each software component of the second outcome-free game portion that is merged into the regulated second version of the game, maintaining a list of the unique certificates associated with the second outcome-free game portion developed by at least one freelance developer, producing an audit log of regulated second versions of the game played on the regulated gaming machine, the audit log containing traces of the unique certificates recorded when each code signed software component may be executed, and deriving usage metrics of played regulated second versions of the game from the audit logs using the traces of the unique code signing certificates. A step may be carried out to maintain an accounting of an amount to pay the freelance game developer(s) according to the derived usage metrics. The gaming exchange may further include a database and a search engine, and the method further may include a step of the search engine receiving search queries from the home player, the game operator and/or the game developer and retrieving data from the database. The search engine may further carry out steps of crawling the first and second repositories, generating at least one index of a plurality of documents found during the crawling step that contain human readable game information for each game, and recording the at least one index into the database. The method may include a step of recording in the database, and making available to the search engine, usage metrics of players, promotions offered by casinos, list of games offered by casinos, advertising offered by freelance developers, attributes of the games available in the gaming exchange and/or download metrics, for example.

Another embodiment of the present invention is a regulated gaming exchange. Such a regulated gaming exchange may include a first repository selectively accessible to home players over a computer network, the first repository storing an unregulated first version of a game that is configured for game play on a home computing device, the unregulated first version of the game being uncertified by a gaming software certification laboratory and including a first outcome-free game portion and a first outcome-bearing game portion, the unregulated first version of the game being configured to enable wagering only with virtual money; a second repository selectively accessible over the computer network to operators of regulated gaming machines, the second repository storing a regulated second version of the game that is configured for game play on a regulated gaming machine and that may be certified by the gaming software certification laboratory and including a second outcome-free game portion and a second outcome-bearing game portion, the second version of the game being configured to enable wagering with real money, the second outcome-free game portion being substantially identical to the first outcome-free game portion.

Source code of the second outcome-free game portion need not be submitted to the gaming software certification laboratory. The unregulated first version of the game may be configured to not make use of Internet communication and Internet display technologies to execute and play on the home computing device. The first outcome-free portion of the unregulated first version of the game may be configured to not make use of Internet communication and Internet display technologies to execute and play on the home computing device. A graphics portion of the unregulated first version of the game may be configured to not make use of Internet communication and Internet display technologies to execute and play on the home computing device. The unregulated first version of the game may be configured to not make use of Internet communication and Internet display technologies to execute and play on the home computing device. The Internet communication technologies may include (without limitation) an HTTP Request, an HTTP Reply, a cookie and/or a Secure Socket Layer (SSL), for example. The Internet display technologies may include (without limitation), an Internet browser, HTML, a Java Scrip, a Java applet, a Scriptlet, an ActiveX control, a plug-in, a pop-up and/or a cookie, for example. The first outcome-free game portion of the unregulated first version of the game may be identical to the second outcome-free game portion of the regulated second version of the game. Source code of the first outcome-free game portion of the unregulated first version of the game may be substantially identical to source code of the second outcome-free game portion of the regulated second version of the game. Source code of the first outcome-free game portion of the unregulated first version of the game may be identical to source code of the second outcome-free game portion of the regulated second version of the game. Executable code of the first outcome-free game portion of the unregulated first version of the game may be substantially identical to executable code of the second outcome-free game portion of the regulated second version of the game. Executable code of the first outcome-free game portion of the unregulated first version of the game may be identical to executable code of the second outcome-free game portion of the regulated second version of the game.

The first repository and the second repository may be selectively accessible at a predetermined computer site. The predetermined computer site may include an Internet portal, for example. The source of randomization in the unregulated first version of the game may be different than the source of randomization in the regulated second version of the game. The unregulated first version of the game may be configured to store critical meters in a different type of non-volatile storage media than is the regulated second version of the game. The executable code of the unregulated first version of the game may be configured to store critical meters in a different type of non-volatile storage media than is the executable code of the regulated second version of the game. The game software of the unregulated first version of the game may be substantially identical to a game software of the regulated second version of the game, except that the regulated second version of the game (a) allows for wagering using real money, (b) uses a certified source of random outcome, (c) stores critical meters on certified non-volatile memory, (d) provides functionality for player dispute resolution and/or (e) communicates with a central game management system. The source code of the unregulated first version of the game may be substantially identical to a source code of the regulated second version of the game, except that the regulated second version of the game (a) allows for wagering using real money, (b) uses a certified source of random outcome, (c) stores critical meters on certified non-volatile memory, (d) provides functionality for player dispute resolution and/or (e) communicates with a central game management system. Each software component of the unregulated first version of the game may be code-signed with a unique certificate and the home computing device may be configured with associated software restriction policies. Each software component of the regulated second version of the game may be code-signed with a unique certificate and the gaming machine may be configured with associated software restriction policies. The first and/or second repositories may include selectively accessible usage metrics of game play of the unregulated first version of the game played on the home computing device. The first and/or second repositories may include selectively accessible contact details of a player of the unregulated first version of the game on the home computing device. The first and/or second repositories may include a selectively accessible preference profile of a player of the unregulated first version of the game on the home computing device.

The regulated second version of the game may be configurable according to the preference profile. The usage metrics may be stored on a predetermined computer site and may be selectively available to an operator of the regulated gaming machine, a developer of the regulated second version of the game, a developer of the first and second outcome-free game portions and/or a developer of the unregulated first version of the game, for example. The first outcome-free game portion of the unregulated first version of the game may be modified according to the usage metrics. The predetermined computer site may include promotional information to be sent to players of the unregulated first version of the game having provided their contact details. The predetermined computer site may include a notice of availability of the regulated second version of the game on regulated gaming machines to be sent to players of the unregulated first version of the game. The predetermined computer site may be selectively accessible to a plurality of operators of regulated gaming machines. The predetermined computer site may be accessible to a plurality of freelance game developers. The regulated second version of the game may be available for download by a plurality of operators of regulated gaming machines from the predetermined computer site. The predetermined computer site may be configured to enable uploads of unregulated first versions of games. The predetermined computer site may be configured such that the stored usage metrics are selectively available to operators of regulated gaming machines. The predetermined computer site may be configured such that the stored usage metrics are selectively available to freelance game developers. The predetermined computer site may be configured such that the stored usage metrics are selectively available to players playing on their home computing devices. The home computing device may be a personal computer (PC), a mobile computer or a game console, for example.

The central management system may be further configured to generate the usage metrics of played regulated second versions of the game by code signing with a unique certificate each software component of the second outcome-free game portion that is merged into the regulated second versions of the game, maintaining a list of the unique certificates associated with the second outcome-free game portion developed by at least one freelance developer, producing an audit log of regulated second versions of the game played on the regulated gaming machine, the audit log containing traces of the unique certificates recorded when each code signed software component is executed, and deriving the usage metrics of played regulated second versions of the game from the audit logs using the traces of the unique code signing certificates. The game operator may be further configured to maintain an accounting of an amount to pay the freelance game developer(s) according to the derived usage metrics. A database and search engine may also be provided, the search engine being configured to receive search queries from the home player, the game operator and/or the game developer, and to retrieve data from the database. The search engine may be further configured to crawl the first and second repositories and to generate at least one index of a plurality of documents containing human readable game information for each game and to record the index into the database. The database may be further configured to record and to make available to the search engine usage metrics of players, promotions offered by casinos, list of games offered by casinos, advertising offered by freelance developers, attributes of the games available in the gaming exchange and/or download metrics, for example.

According to yet another embodiment, the present invention is a method of distributing a regulated game for regulated gaming machines. The method may include steps of a first receiving step for receiving an unregulated first version of a game including a first outcome-free game portion and a first outcome-bearing game portion, the received unregulated first version of the game being configured to enable wagering using only virtual money; a first making step to make the received unregulated first version of the game available for download to a plurality of home computing devices; a second receiving step for receiving a regulated second version of the game including a second outcome-free game portion and a second outcome-bearing game portion, the regulated second version of the game being configured to enable wagering using real money, the second outcome-free game portion being substantially identical to the first outcome-free game portion; a second making step to make the regulated second version of the game selectively available for download to a regulated gaming machine.

The regulated second version of the game in the second receiving step may be certified by a gaming software certification laboratory. The first receiving step may be carried out such that source code of the second outcome-free game portion is not submitted to a gaming software certification laboratory. The first receiving step may be carried out with the unregulated first version of the game being configured to not make use of Internet communication and Internet display technologies to execute and play on the home computing device. The first receiving step may be carried out with the first outcome-free portion of the unregulated first version of the game being configured to not make use of Internet communication and Internet display technologies to execute and play on the home computing device. The second receiving step may be carried out with the graphics portion of the unregulated first version of the game being configured to not make use of Internet communication and Internet display technologies to execute and play on the home computing device. The Internet communication technologies may include (without limitation) an HTTP Request, an HTTP Reply, a cookie and/or a Secure Socket Layer (SSL), for example. The Internet display technologies may include (without limitation) an Internet browser, HTML, a Java Scrip, a Java applet, a Scriptlet, an ActiveX control, a plug-in, a pop-up and/or a cookie, for example. The first and second receiving steps may be carried out such that the first outcome-free game portion of the unregulated first version of the game is identical to the second outcome-free game portion of the regulated second version of the game. The first and second receiving steps may be carried out such that source code of the first outcome-free game portion of the unregulated first version of the game is substantially identical to source code of the second outcome-free game portion of the regulated second version of the game. The first and second receiving steps may be carried out such that source code of the first outcome-free game portion of the unregulated first version of the game is identical to source code of the second outcome-free game portion of the regulated second version of the game. The first and second receiving steps may be carried out such that executable code of the first outcome-free game portion of the unregulated first version of the game is substantially identical to executable code of the second outcome-free game portion of the regulated second version of the game. The first and second receiving steps may be carried out such that executable code of the first outcome-free game portion of the unregulated first version of the game is identical to executable code of the second outcome-free game portion of the regulated second version of the game.

The method may also include a step of storing the received unregulated first version of the game in a first repository that is selectively accessible from a predetermined computer site over a computer network and a step of storing the received regulated second version of the game in a second repository that is selectively accessible through the predetermined computer site. The predetermined computer site may include an Internet portal. The first and second receiving steps may be carried out such that the source of randomization used in the regulated second version of the game is different than the source of randomization used in the unregulated first version of the game. The developing steps may be carried out such that the regulated second version of the game is configured to store critical meters in a different type of non-volatile storage media than is the unregulated first version of the game. The developing steps may be carried out such that the executable code of the regulated second version of the game is configured to store critical meters in a different type of non-volatile storage media than is the executable code of the regulated second version of the game. The first and second receiving steps may be carried out such that the game software of the regulated second version of the game is substantially identical to the game software of the unregulated first version of the game, except that the regulated second version of the game (a) allows for wagering using real money, (b) uses a certified source of random outcome, (c) stores critical meters on certified non-volatile memory, (d) provides functionality for player dispute resolution and/or (e) communicates with a central game management system, for example. The first and second receiving steps may be carried out such that the source code of the regulated second version of the game is substantially identical to the source code of the unregulated first version of the game, except that the regulated second version of the game (a) allows for wagering using real money, (b) uses a certified source of random outcome, (c) stores critical meters on certified non-volatile memory, (d) provides functionality for player dispute resolution and/or (e) communicates with a central game management system. The first and second receiving steps may be carried out such that each software component of the unregulated first version of the game is code-signed with a unique certificate and the home computing device is configured with associated software restriction policies. The first and second receiving steps may be carried out such that each software component of the regulated second version of the game is code-signed with a unique certificate and the regulated gaming machines is configured with associated software restriction policies. The method may also include a step of receiving usage metrics of game play of the unregulated first version of the game played on the home computing device. A step may be carried out of receiving contact details of a player of the unregulated first version of the game on the home computing device. A preference profile of a player of the unregulated first version of the game may be received on the home computing device. The method may also include a step of sending the preference profile of the player of the unregulated first version of the game to the regulated gaming machine. The regulated second version of the game may be configured according to the preference profile. The received usage metrics may be stored on a predetermined computer site and the stored usage metrics may be made available to an operator of the regulated gaming machine, a developer of the regulated second version of the game, a developer of the first and second outcome-free game portions and/or a developer of the regulated second version of the game, for example. A step may be carried out of the operator of the regulated gaming machine selecting the regulated second version of the game for download to the regulated gaming machine in accordance with the usage metrics. The method may also include a step of modifying the second outcome-free game portion of the regulated second version of the game in accordance with the usage metrics. The method may also include a step of sending promotional information to players of the unregulated first version of the game having provided their contact details. A notice of availability of the regulated second version of the game on the regulated gaming machine may be sent to players of the unregulated first version of the game. A step may be carried out of making the predetermined computer site accessible to a plurality of operators of regulated gaming machines. A step may also be carried out of making the predetermined computer site accessible to a plurality of freelance game developers. The regulated second version of the game may be made available for download by a plurality of operators of regulated gaming machines from the predetermined computer site. Uploads of regulated second versions of games may be carried out to the predetermined computer site. The method may further include a step of configuring the predetermined computer site such that the stored usage metrics are selectively available to operators of regulated gaming machines. A step of configuring the predetermined computer site may be carried out such that the stored usage metrics are selectively available to freelance game developers.

The method may also include a step of configuring the predetermined computer site such that the stored usage metrics are selectively available to players playing on their home computing devices. The home computing device may be, for example, a personal computer (PC), a mobile computer or a game console. The method may also include code signing with a unique certificate each software component of the second outcome-free game portion that is merged into the regulated second versions of the game; maintaining a list of the unique certificates associated with the second outcome-free game portion developed by at least one freelance developer; producing an audit log of regulated second versions of the game played on the regulated gaming machine, the audit log containing traces of the unique certificates recorded when each code signed software component may be executed, and deriving usage metrics of played regulated second versions of the game from the audit logs using the traces of the unique code signing certificates. The method may also include a step of maintaining an accounting of an amount to pay the freelance game developer(s) according to the derived usage metrics. The gaming exchange may further include a database and a search engine, and the method further may include a step of the search engine receiving search queries from the home player, the game operator and/or the game developer and retrieving data from the database. The search engine may further carry out steps of crawling the first and second repositories, generating at least one index of a plurality of documents found during the crawling step that contain human readable game information for each game, and recording the index into the database. The method may also include a step of recording in the database, and making available to the search engine, usage metrics of players, promotions offered by casinos, list of games offered by casinos, advertising offered by freelance developers, attributes of the games available in the gaming exchange and/or download metrics, for example.

BRIEF DESCRIPTION OF THE DRAWINGS

FIG. 15 illustrates the architecture of a game exchange portal, according to an embodiment of the invention.

DETAILED DESCRIPTION

Reference will now be made in detail to the construction and operation of preferred implementations of the present invention illustrated in the accompanying drawings. The following description of the preferred implementations of the present invention is only exemplary of the invention. The present invention is not limited to these implementations, but may be realized by other implementations.

Figure 1:
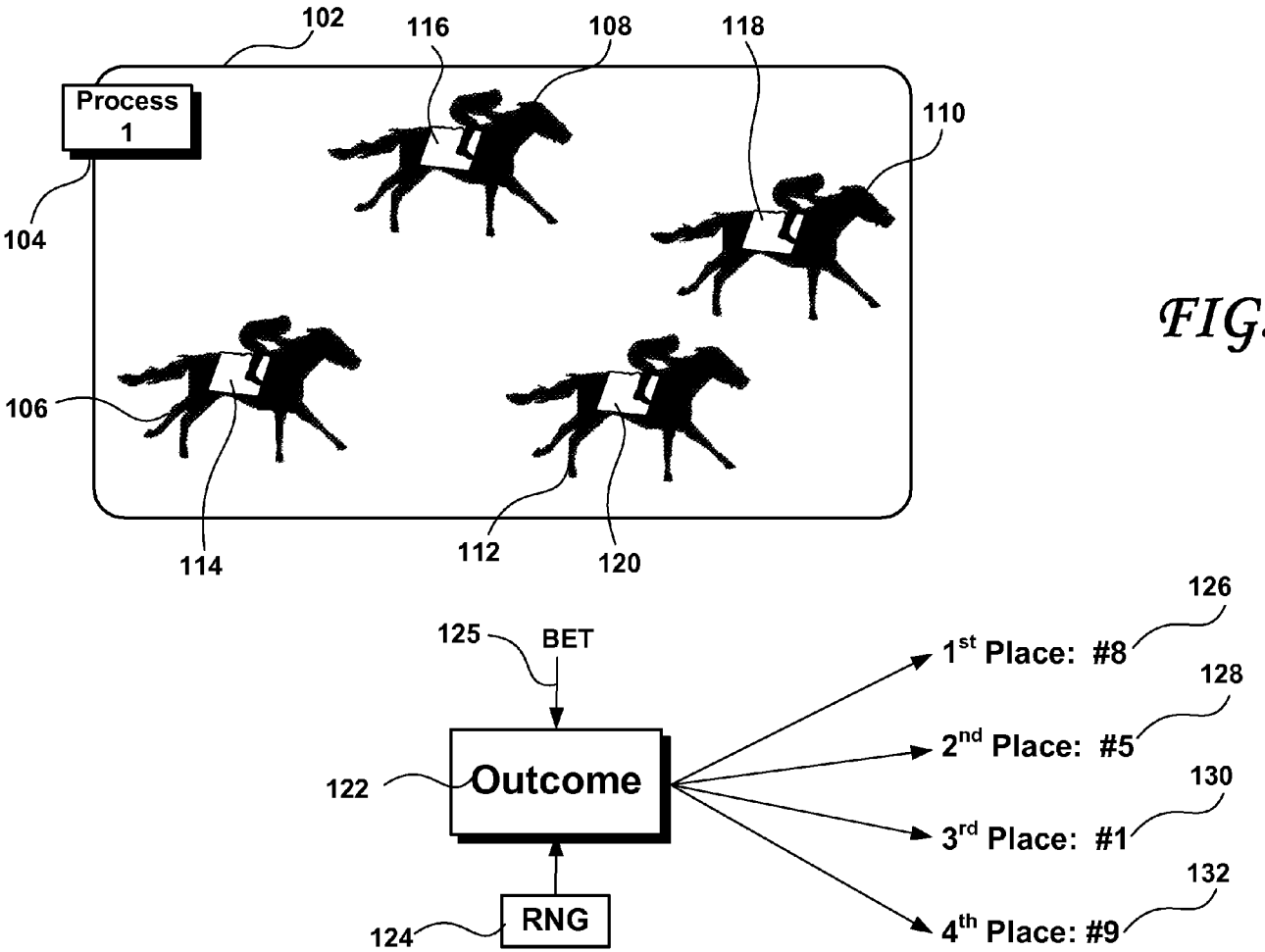
FIG. 1 illustrates the rendering of the entertainment graphics developed by a freelance game software developer and the process of producing outcome graphic assets developed by the casino supplier, according to an embodiment of the present invention.

FIG. 1 illustrates the rendering of the entertainment "outcome free" graphics developed by a freelance game software developer and the process of producing outcome graphic assets developed by the casino supplier, according to an embodiment of the present invention. Embodiments of the present invention are presented herein using a horse racing game as an exemplary embodiment. However, it is to be understood that the present inventions are not to be so limited, as most any type of game may be used to great advantage.

Keeping the foregoing in mind, according to an embodiment of the invention, a horse racing graphic animation (which may be and/or include, for example, a video playback) controlled by a process 104 may be rendered in a video plane 102. The animation scene in FIG. 1 includes four horses 106, 108, 110 and 112. The horse racing animation may be rendered in a video plane by the freelance code executing in a process sandbox using pre-recorded video or realistic real-time 3D animation, the rendering being such that each horse number indicia usually printed on a blanket 114, 116, 118 and 120 attached to the saddle is totally obfuscated. Consequently it is impossible, from viewing the animation of the freelance code, to know or otherwise determine which horse is leading and will eventually win the race, as well as the order of the other horses across the finish line. In addition, other identifying features that may help in identifying horses (such as the jockey's jacket color and the horse's color or other identifying markings, for example) may also be obfuscated. Moreover, the voice-over or sound should not give any indication of the leading horses. Thus, the background plane may constitute a dazzling entertaining scene that is free from any markings (i.e. numbers, colors, shapes) that would reveal the outcome of the game, together with realistic sound.

A process sandbox is a term commonly employed in computer technology to denote that the running process is given restricted memory access and restricted execution permissions such as not to interfere with other resources (e.g. processes, memory, disk storage, video, etc. . . . ) outside defined boundaries. (The process sandbox technique is also commonly known in the US army software requirement as secure compartmenting for a multilevel secure operating system as defined in the DoD 5200.28-STD standard and the associated Orange book and the rainbow series. The process sandbox technique is being further researched at Microsoft Research under the "Singularities" and "Virtualization" initiatives wherein Software Isolated Processes (SIPs) communicate and interact via "channels" and "contracts" which provide a fully defined and protected security partitioning for inter-process communication and wherein virtualization of the Windows operating system will be controlled by the "Hyper-Visor" virtualization engine; these technologies are likely to be released after Windows Vista. The process sandbox technique is also commonly referred as strong process isolation). This may be achieved using advanced and secure resource management such as, but not limited to, hardware enforced memory management, ACL (Access Control List), trusted computing base (i.e. implementing security initiatives of the TCG Trusted Computing Group: TPM, TNC, secure BIOS, secure storage, etc. . . . or equivalent technologies), software restriction policy, anti-virus, kernel virtualization, I/O virtualization, and other security mechanisms embedded in advanced 64-bit CPU. In addition, forthcoming graphics controllers comprising embedded hardware security module may ensure that no process may access unauthorized video resources. Consequently, the executing freelance software cannot interfere with the regulated software installed or executing on the gaming controller, including unauthorized writing and reading of information to/from the video display and hidden video display cache.

Accordingly and according to an embodiment of the present invention, the outcome-free game software or processes may be configured to execute in a first process sandbox in which it is given compartmented memory access and/or compartmented execution permissions. The outcome-free game software or processes may be configured to execute in a first process sandbox that may include, for example, strong process isolation, DoD 5200.28-STD multilevel security, Microsoft Software Isolation Process (SIP) and/or JAVA sandbox. Likewise, the outcome-providing game software or processes may be configured to execute in a second process sandbox in which it is given compartmented memory access and/or compartmented execution permissions. For example, the outcome-providing game software may be configured to execute in a second process sandbox that may include, for example, process isolation, DoD 5200.28-STD multilevel security, Microsoft Software Isolation Process (SIP) and/or JAVA sandbox.

As shown in FIG. 1, the horse number indicia 126, 128, 130 and 132 may be generated by an outcome engine process 122 seeded by a random number generator (RNG) 124 subsequent to the BET button 125 being pressed. The code for the outcome engine process 122 is under the control of the slot supplier and is certified—in contradistinction from the executing freelance code, which need not be certified or under the control of the slot supplier. Note that the freelance code may, in fact, originate from the slot supplier. This would, in effect, streamline the slot supplier's software certification process, as only the relatively lean code for the outcome engine process 122 need be submitted to the certification lab for certification—as this is the only code that is in any way involved in the outcome of the game.

Figure 2:
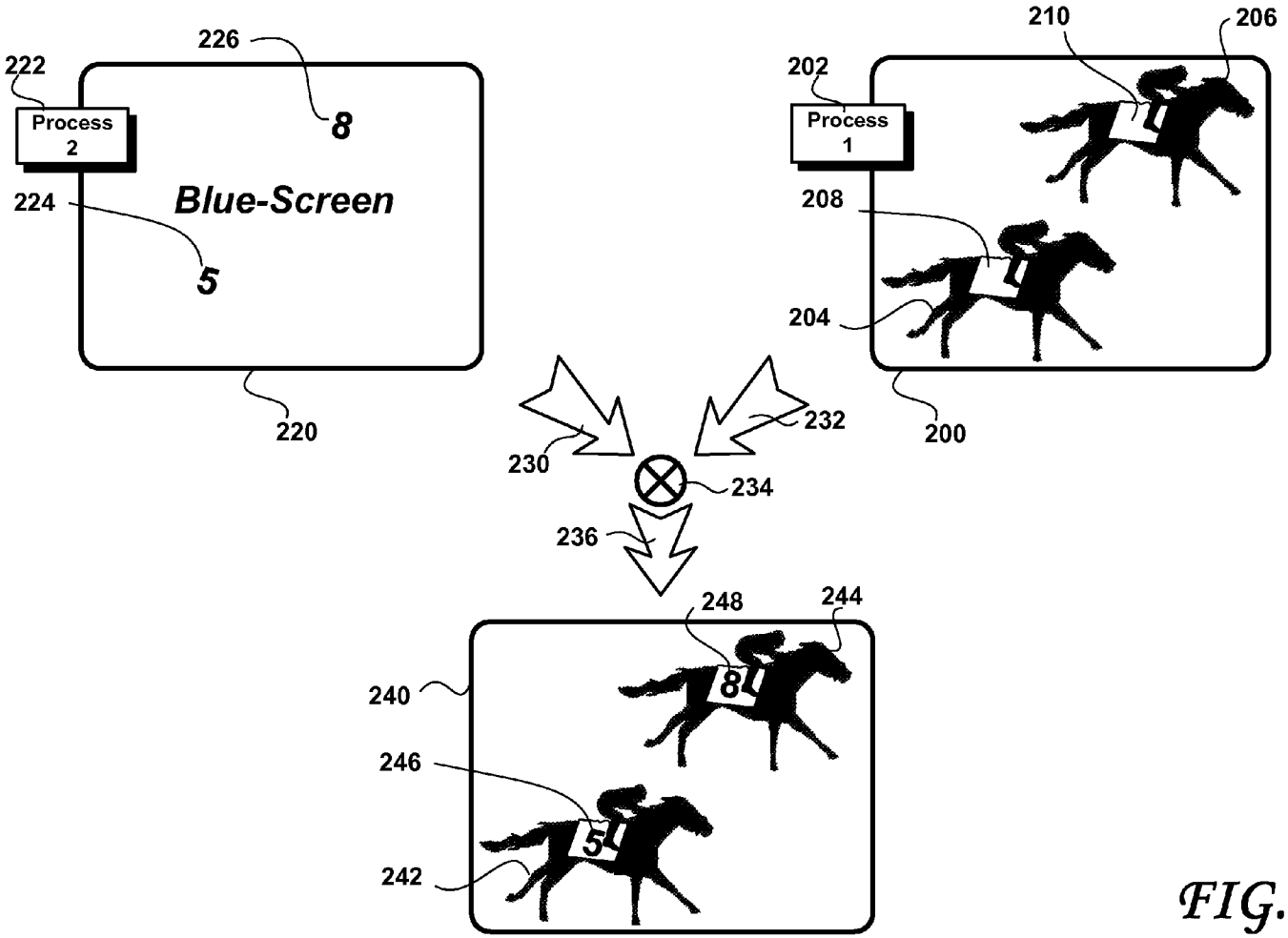
FIG. 2 illustrates the overlay of the entertainment graphics and of the rendered outcome graphic assets, according to an embodiment of the present invention.

FIG. 2 illustrates the overlay of the entertainment graphics and of the rendered outcome graphics, according to an embodiment of the present invention. In the illustrated horse racing scene controlled by process 1 at reference numeral 202 and rendered in a video plane 200, a single video frame comprising two horses 204 and 206 are displayed with their associated numbers obfuscated, as shown at 208 and 210. The horse numbers 224 and 226 (which may constitute at least part of the outcome of the game), according to an embodiment of the present invention, may be generated by the outcome process 122 (shown in FIG. 1) and rendered in a single corresponding video frame in the video plane 220 by process 2, shown at reference numeral 222. The two video planes 200 and 220 may then be combined as indicated by reference numerals 230, 232, 234 and 236 into a merged video plane 240. The single merged video frame shows the two horses 242 and 244 with the corresponding horse numbers 246 and 248 visible on the saddle blanket.

The horse number indicia 126, 128 may be rendered in a video plane 220 as graphic gadgets (in the exemplary embodiment shown in FIGS. 1 and 2, horse numbers) 224, 226 controlled by the certified slot supplier code 222 executing in a process sandbox isolated from the uncertified freelance process 202 running in another sandbox. Graphic gadgets, according to embodiments of the present invention, are small graphic objects behaving much like small windows that may be rendered and moved individually over a background scene. However, graphics gadgets are not necessary limited to a rectangular shape. Graphic gadgets may be circular for rendering a clock for example and of arbitrary outline. Other shapes for such graphic gadgets are possible. Graphic gadgets may also be semi transparent using alpha-blending technology and may have a controllable transparency. Furthermore, graphic gadgets may be 3D animated graphic objects and thus the outline of the 3D object over the background scene may be cut in real-time accordingly. The term "graphics gadget" is used herein to emphasize the fact that the controlling process behind the graphics gadget is structured to be isolated by a process sandbox and a corresponding video sandbox, the video sandbox ensuring that (a) the gadget cannot be hidden or overlapped by an unauthorized process trying to write to the display or the video cache, and that (b) an unauthorized process cannot read the display or the video cache of the graphics gadget such as to determine the outcome that is rendered.

Figure 3:
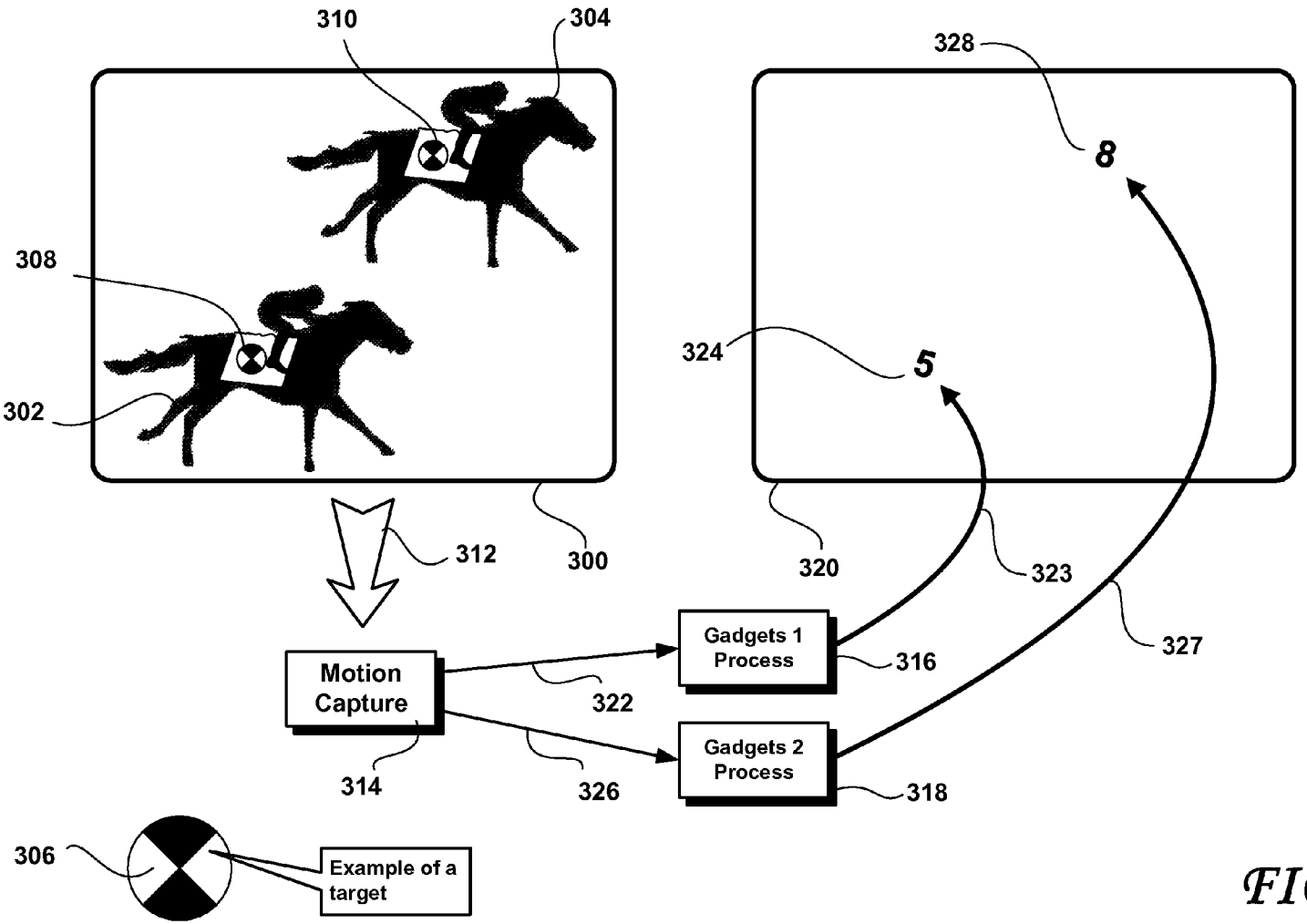
FIG. 3 illustrates the synchronization of the rendered outcome graphic gadgets using the motion capture from the entertainment rendering graphics, according to an embodiment of the present invention.

FIG. 2 shows the merging of a single frame of entertainment graphics and of a corresponding single frame containing rendered outcome gadgets. FIG. 3 illustrates the synchronization of the rendered outcome gadgets using the motion capture from the entertainment graphics such as to obtain a continuous merged video sequence, according to embodiments of the present invention. For motion capture, targets may be inserted in the video sequence, such that they may be recognized by image analysis software. An example of target is shown at numeral 306. According to an embodiment of the present invention, targets may, therefore, be inserted in the freelance entertainment horse race graphics animation at the location(s) where the outcome assets are to be overlaid. In the exemplary scene 300 in FIG. 3, the target 308 is inserted on the saddle blanket of horse 302, and the target 310 is inserted on the saddle blanket of horse 304. Each of the video frames composing the animated outcome-free horse race may be analyzed as suggested by 312 by a motion capture process 314 that identifies the targets 308 and 310 and then derives their exact location on each frame. The target locations may then be forwarded as shown at 322 and 326 to the gadget processes 316 and 318 that will render 323, 327 the horse numbers 324 and 328 at the corresponding target locations, frame-by-frame, such that a seamless merged horse race animation is displayed to the player. Indeed, the motion capture software may derive other scene attributes such as without limitation, location, path, velocity, scale, orientation, rotation, lighting parameters, camera angle, such that the rendered outcome gadget may render the outcome assets more realistically. Moreover, the target may comprise a plurality of video attributes that may be more easily decoded by the motion capture software for deriving scene attributes such as without limitation, location, path, velocity, scale, orientation, rotation, lighting parameters, camera angle, such that the rendered outcome gadget may render the outcome assets more realistically. Hidden video attributes may advantageously be used.

Figure 4:
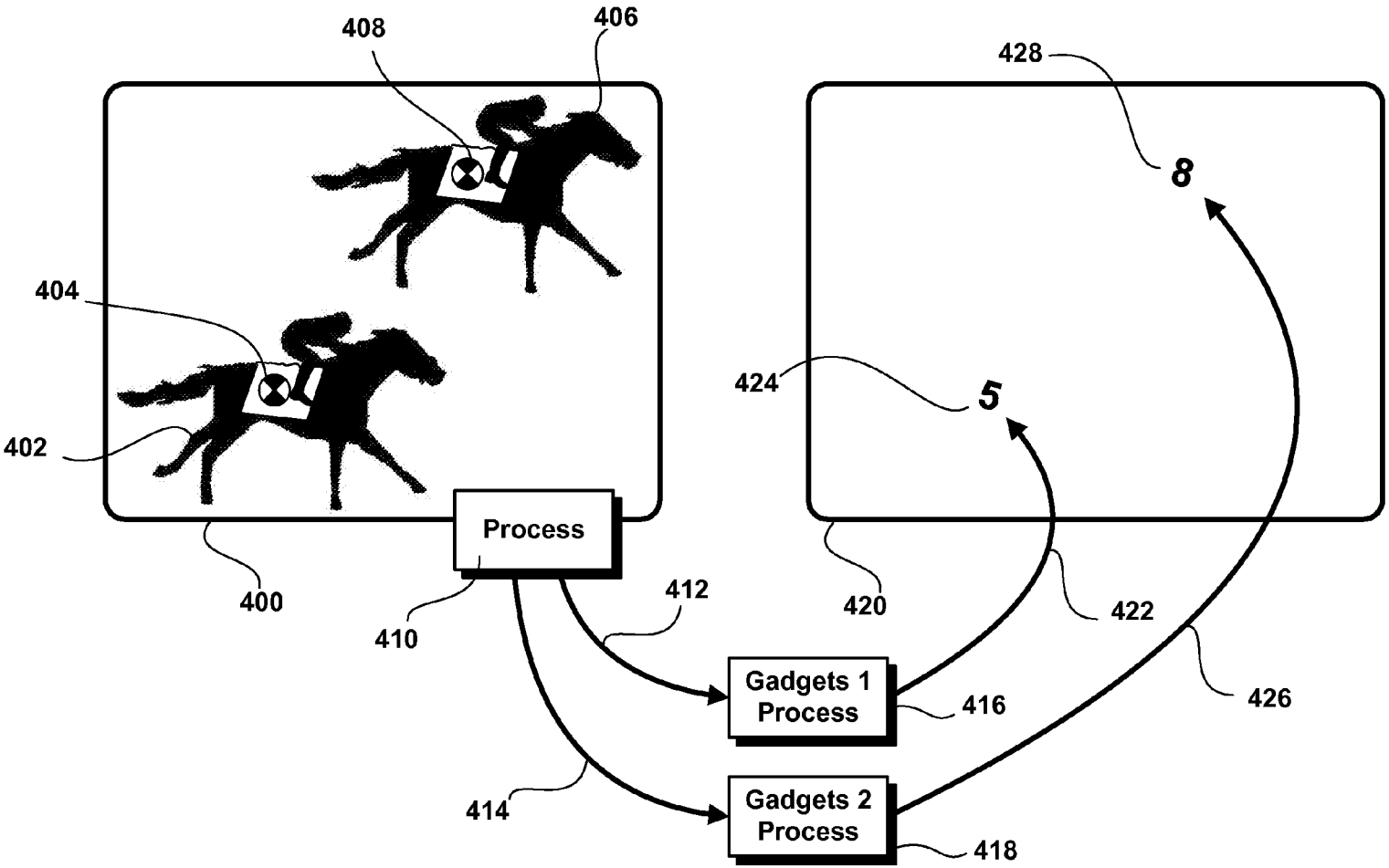
FIG. 4 illustrates the synchronization of the rendered outcome gadgets using a programming interface from the entertainment rendering process, according to an embodiment of the present invention.

FIG. 4 illustrates the synchronization of the rendered outcome graphic gadgets using a programming interface from the entertainment graphics such as to obtain a continuous merged video sequence, according to an embodiment of the present invention. In the exemplary scene 400, the location of target 404 on the saddle blanket of horse 402, and the location of target 408 on the saddle blanket of horse 406 are forwarded directly, as indicated at 412 and 414 by freelance process 410 to the gadget processes 416 and 418 that will render, at 422 and 426, the horse numbers 424 and 428 at the corresponding respective target locations frame-by-frame such that a seamless merged horse race animation is displayed to the player. Indeed, the freelance process 410 may provide other scene attributes such as, without limitation, location, path, velocity, scale, orientation, rotation, lighting parameters, camera angle, such that the rendered outcome gadget may render the outcome assets more realistically.

As may be apparent to those of skill in the art of video graphics animation and synchronization, other synchronization schemes may be employed that rely on a direct programming interface, either frame-by-frame, by sequence of frames or for the entire animation sequence. For example, if the animation is a replay of a pre-recorded animation, the overall path for each target may be provided via the programming interface.

Figure 5:
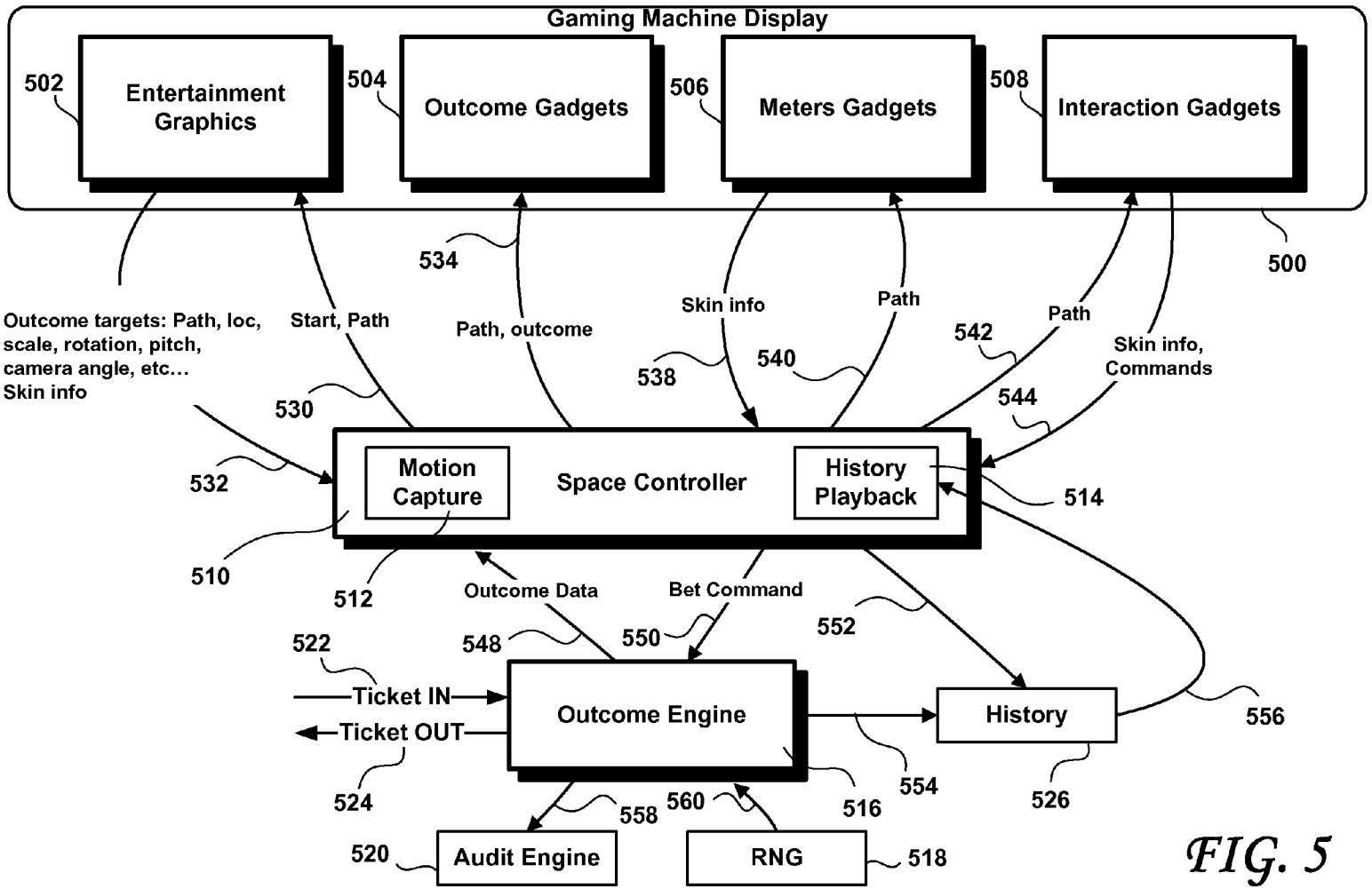
FIG. 5 illustrates an overall game architecture, according to an embodiment of the invention.

FIG. 5 illustrates a game architecture according to an embodiment of the invention in which a space controller coordinates the various animations and interactions. The gaming machine video display 500 (which may include one, two or more video display panels) may display essentially four categories of graphic objects: (a) outcome-free entertainment graphic objects 502, (b) outcome graphic object 504, (c) meters objects 506 and (d) interaction objects 508. There may be more categories of graphic objects depending on the type and complexity of the game (multiplayer, multi-screen, for example). These graphic objects may be each controlled by an individual process and the combination graphic object and controlling process is named "gadget" hereafter. Graphic gadgets 504, 506 and 508 may be resizable and located anywhere on any of the display panels. The entertainment graphic object 502 may be or include a background scene taking the entirety of one or several video display panels or alternatively taking a portion of a single display only. The entertainment graphic object 502 may include one or a plurality of resizable gadgets that may be located anywhere on any of the display panels. The entertainment graphic objects do not display any outcome-bearing information, identification, shapes or colors (which is why it need not be submitted to or certified by a software certification lab). The process controlling the entertainment graphics may be, according to an embodiment of the present invention, be totally isolated in a sandbox process or may execute on a separate computing controller.

The outcome gadgets may display outcome-bearing information such as, but not limited to, identification marks, numerals, shapes and colors. The meters gadgets may display the meters of the games such as but not limited to credit, last win and denomination. The interaction gadgets may be the visible or invisible graphic objects with which the player may interact such as, but not limited to, a bet button, wager selection, denomination selection, lines selection, chips, help button and cash-out button. Help and prize matrix may be interaction gadgets.

The graphics objects and gadgets may be displayed anywhere on the video display(s) of the gaming machine with any viewing attributes such as location, scale, orientation, illumination (one or several light sources), opacity and plane position (on top, in back, in between, etc.). Gadgets may be rendered in rectangular or non-rectangular windows, or in sprites. Gadgets may be rendered as full 3D animated objects.

The display rendering of all the gadgets on the video display is controlled by a space controller 510 that is configured to coordinate all the 2D/3D viewing attributes of each of the graphic objects and gadgets such as to enable the player to experience a seamless game session. Hereafter, the 2D/3D viewing attribute of each gadget or graphic object is referenced as "path" 530, 534, 540 and 542 in FIG. 5. The path of each gadget may be controlled frame-by-frame, by aggregate of frames, or for the entire viewing sequence, whichever is more appropriate for each gadget. The space controller 510 may receive the outcome data 548 from the outcome engine 516 and forward 534 the outcome information together with the path to each of the associated outcome gadgets 504 that will in turn render the graphic animation of the outcome in synchronization with the game entertainment scene. The outcome engine 516 may receive the wager size, bet selections and bet activation as a "command" message 544 from the interaction gadgets.

The presentation style or "skin" of the entertainment gadgets, meter gadgets and the interaction gadgets may be customized by the player and/or by the game operator without requiring any regulatory software re-testing. The customization available to the players and/or to the game operator is limited, to remain in regulatory compliance. Young computer users and gamers who are used to be provided with "skinable" programs and games such as music players and even the entire Microsoft Windows visual appearance (i.e. Aero in Windows Vista) may, therefore, customize the skin of all the display windows and gadgets (entertainment, meters, interactive) and choose their size, location, opacity and dynamic zoom-in/zoom-out (the meters may be visible in small size or with high transparency during game action and may appear in large size and high opacity when the outcome is given). The gadgets may be dock-able via a push-pin icon, and/or de-docked and removed when the pin is removed. In a multi-display gaming machine, the player or the operator may freely choose on which panel to display the various graphics objects or alternatively may choose to combine the panels to make a larger virtual display. Interactive controls (suggested at 1312 in FIG. 13) may be offered to the player to change the skin and/or location, size and any other attribute of the gadgets, and the new skin parameters 532, 538, 544 may be provided to the space controller 510. Such interactive controls may take the form of buttons, joysticks, trackball, touch-sensitive display, for example, as those of skill in this art may appreciate. Accordingly, the space controller 510 may coordinate the path of each of all the gadgets in order to generate a seamless game session.

The space controller 510 may receive the outcome targets path and viewing parameters 532 directly from the entertainment graphics objects 502 or alternatively may derive them via a motion capture process 512. The entertainment graphics objects 502 may receive a start command 530 from the space controller 510 to start viewing the entertainment animation, when the bet button is pressed, for example.

The outcome engine 516 may receive a bet command 550 from the space controller and obtain the raw random numbers 560 from the random number generator 518. The outcome engine may receive player credits via Ticket-In 522 or any other common payment instrument and cash-out via Ticket-Out 524 or other payment instrument. An audit engine 520 may securely store a trace of all regulatory data 558, in NVRAM for example. A history process 526 may record all graphic activity 552 and associated outcome data 554 during a game session, and forward them at 556 to a history playback process 514 such that the space controller may playback a complete game session when required in order to resolve player disputes.

Figure 6:
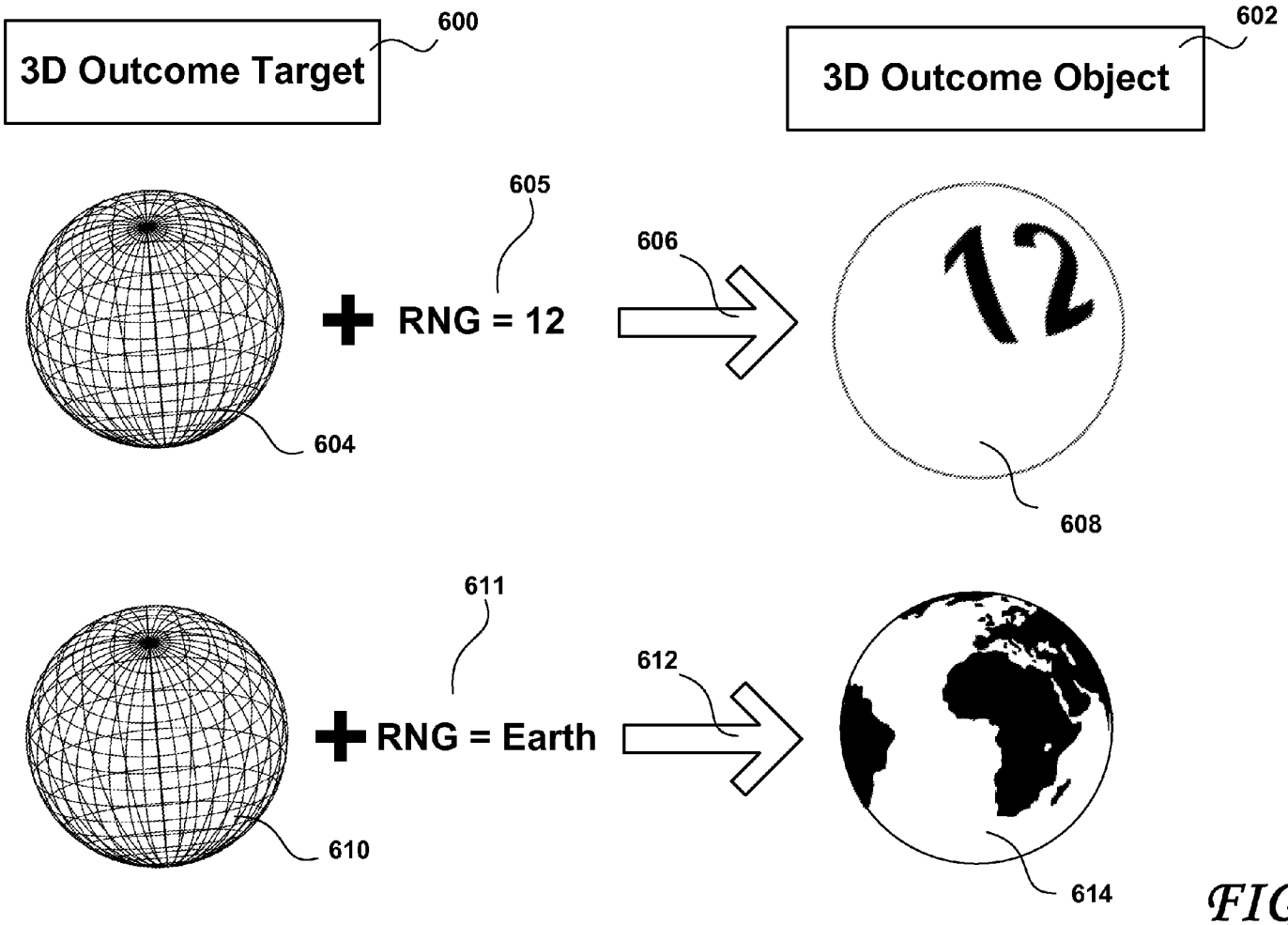
FIG. 6 illustrates the merging of 3D surface targets and 3D outcome skins, according to an embodiment of the invention.

For illustration, FIG. 6 shows the concept of projecting a 3D outcome skin 602 onto a simple neutral spherical 3D outcome target 600, according to further aspects of embodiments of the present invention. In a video pool game example, balls bearing numbers may be rendered as blind 3D spheres 604 by the freelance entertainment graphics objects 502. The 3D spheres 604 are 3D outcome targets that are each being passed (as shown at 532 in FIG. 5) as a 3D model to the space controller 510 together with their associated viewing attributes. In the example of FIG. 6 wherein only one pool ball is illustrated, the number 12 is being drawn by the outcome engine 516 and is forwarded 548 to the space controller. The outcome gadget 504 having the capability to generate and control animated 3D spheres renders a sphere 604 on which a texture or a skin representing the number 12 drawn by the RNG 605 is dynamically projected, as shown at 606. The player will see a seamless rolling ball 608 bearing number 12.

Similarly, in a cosmic voyager game wherein a spacecraft exits light speed travel as it approaches its destination, the planet where it would land is revealed. The planets may be rendered as neutral/blind 3D spheres 610 by the freelance entertainment graphics objects 502. The 3D spheres 610 are 3D outcome targets that are each being passed 532 as a 3D model to the space controller 510 together with their associated viewing attributes. In the example of FIG. 6 wherein only one planet is illustrated, planet earth is being drawn by the outcome engine 516 and is forwarded 548 to the space controller. The outcome gadget 504 having the capability to generate and control animated 3D spheres renders a sphere 610 on which a texture or a skin representing planet earth drawn by the RNG 611 is dynamically projected 612. The player will see a seamless spinning earth planet. Projected outcome skin or textures may be a single fixed image (a number for example) or a video image (a running horse for example) that is warped such as to seamlessly cover the 3D outcome target. Other effects may be applied to the projected outcome skin, such as different textures, shimmering, rippling, bump mapping and all manner of modern graphic manipulations, as those of skill in this art may appreciate.

Figure 7:
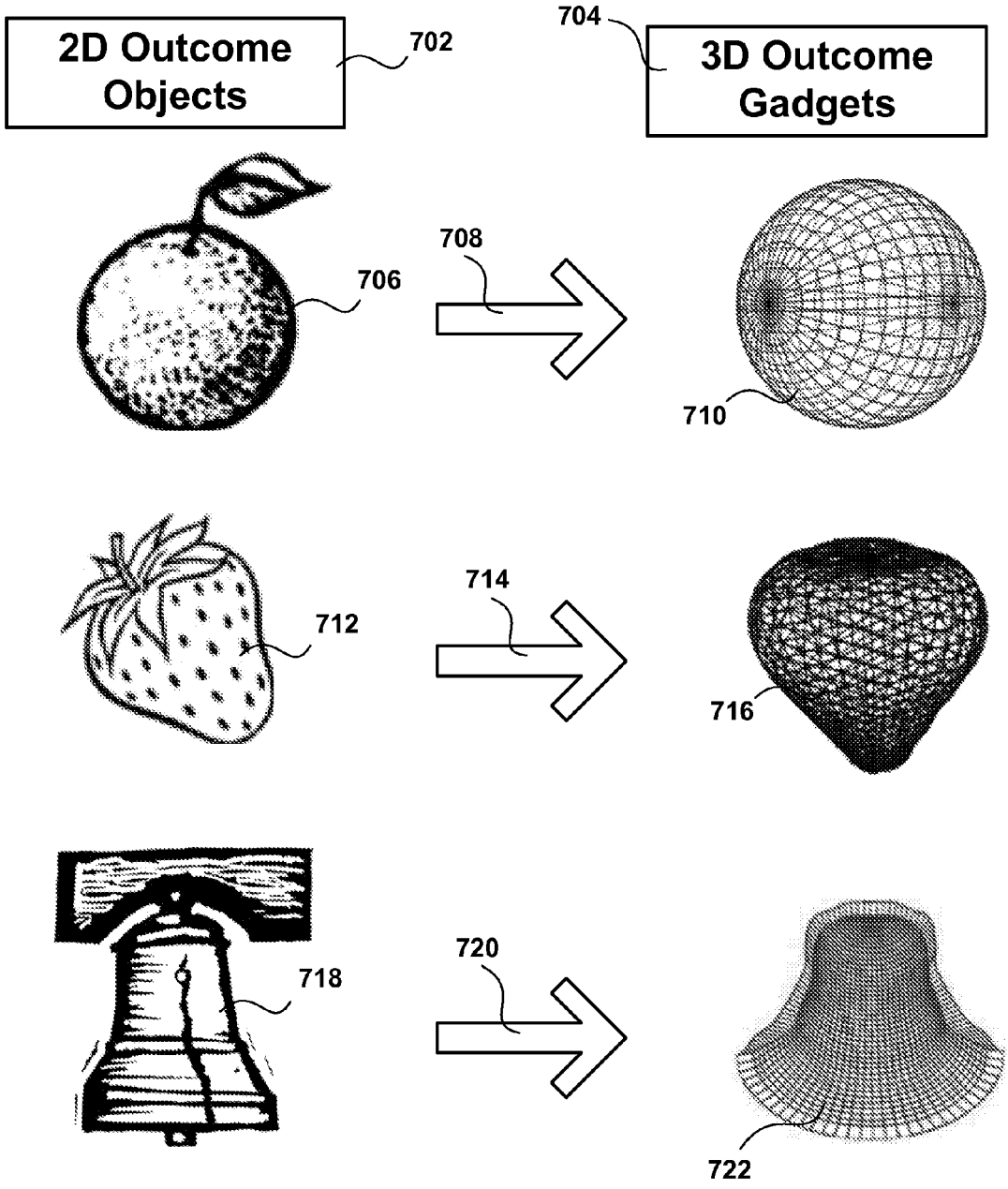
FIG. 7 illustrates 2D outcome objects being replaced with 3D animated outcome graphic gadgets, according to an embodiment of the invention.

FIG. 7 illustrates 2D outcome objects of legacy fruit games being replaced with 3D animated outcome gadgets, according to further aspects of embodiments of the present invention. Legacy fruit games traditionally display 2D fixed or animated 2D outcome objects 706, 712 and 718. It is anticipated that freelance creative minds would rather directly create 3D fruit games in which each individual fruit would appear as animated 3D characters lodged in a virtual cavity located near the surface of a reel that revolves when the player spins the reel. In this instance, the center of a cavity within the reel may be passed by the freelance entertainment graphics objects 502 as an outcome target to the space controller 510. The relevant outcome gadget may render the fruit corresponding to the draw generated by the outcome engine 516. The player will see a dazzling seamless spinning reel, which will then stop to reveal animated 3D fruit.

Figure 8:
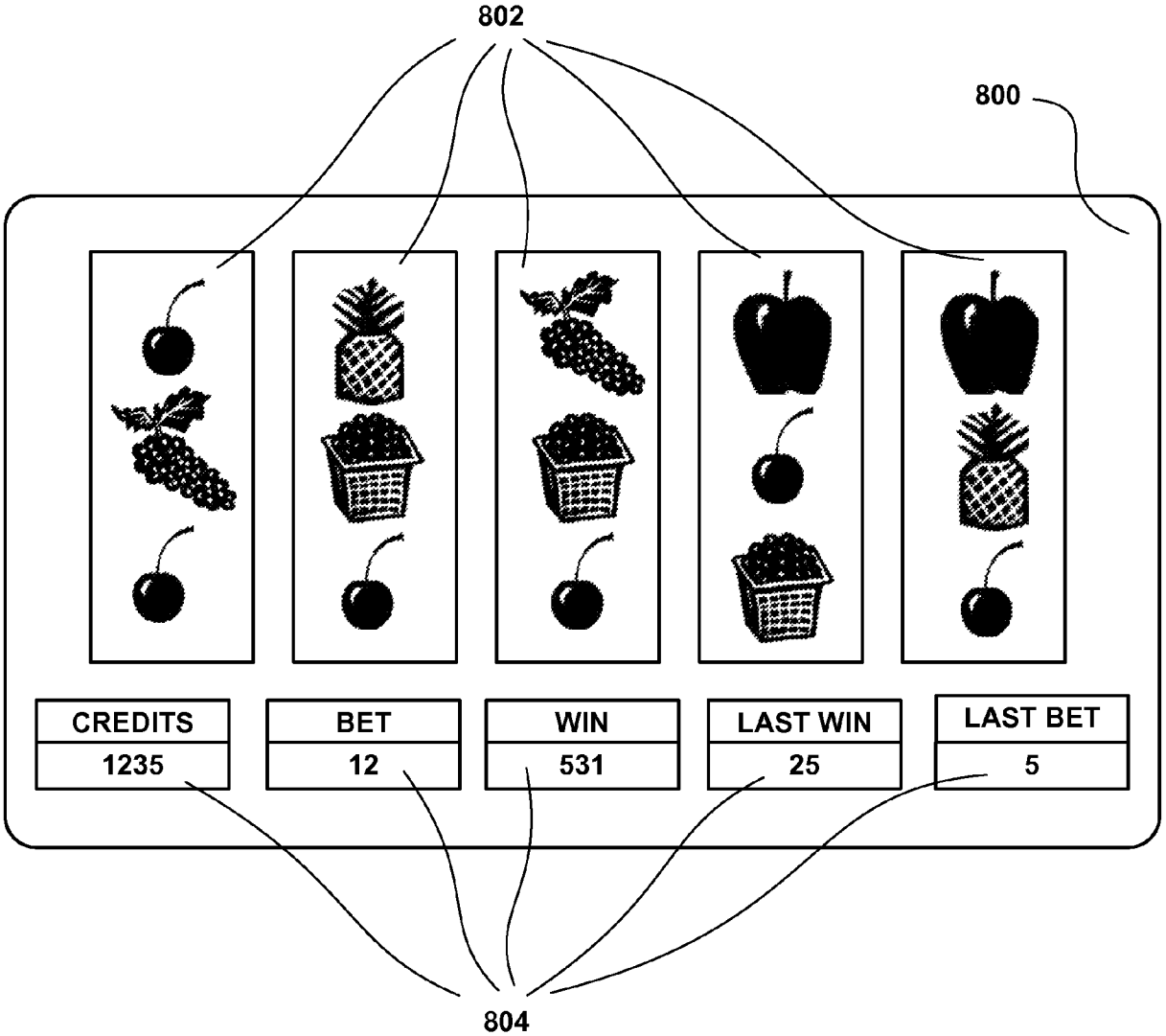
FIG. 8 (Prior Art)
FIG. 8 illustrates conventional gaming machine meters

FIG. 8 illustrates a conventional fruit game in which regulatory meters are displayed at a fixed location. Traditionally, the entire layout 800 is designed such that the reels 802 and the regulatory meters 804 are placed at fixed location. The meters are hand customized by a graphic artist to blend with the game and the overall composition never changes. Some later games use window effects to bring some portion of the screen and meters into focus by enlargement during particular moments of the game session but these effects are limited by what the graphic artist decided at design time and they may not be changed at later time when the game is deployed in a casino.

Accordingly, it is believed desirable to allow casino players to change various aspects of the displayed games to suit their mood, preferences and the available video display real-estate (i.e. single display, multi-display, ultra-high resolution display, plasma display, etc. . . . ). Players, according to further aspects of embodiments of the present invention, may change the style or skin interactively of various game elements and operators may control the parameters centrally or locally via configuration files or centrally federated policies. Player's individually chosen styles may be saved and later recovered and retrieved using, without limitation, a player card or from a central player account. As discussed below and according to further embodiments of the present invention, players may configure their favorite styles and skins on their computers at home and may thereafter retrieve such parameters on the casino floor.

Figure 9:
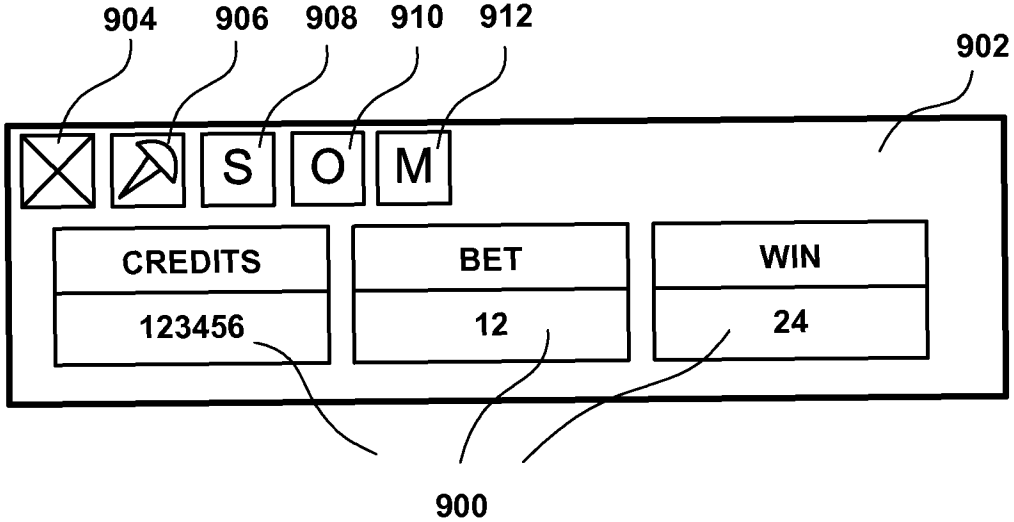
FIG. 9 illustrates the concept of meters being grouped in a docking windows, according to an embodiment of the invention.

According to an embodiment of the present invention illustrated in FIG. 9, the meters 900 may be grouped in a window 902. The window may be of the pop-up or roll-out type that is brought into focus at a particular moment during the game action. Traditionally the meters are placed at a fixed location and are always visible. According to an embodiment of the present invention, however, the player may close the meters window or reduce it to a minimum or smaller size required by regulation by pressing the "close" (or "minimize") button 904. The meters window may return to its initial or previous size upon the occurrence of a particular event during the game session, such as when a win occurs. The player may move the meters window to another location on the current display panel or to another display panel fitted to the gaming machine by pressing and dragging the "move" button 912. The player may resize the meters window by pressing the "Size" button 908, whereupon a menu may pop-up offering various menu sizes. Alternatively, each time the button 908 is pressed, the meters window may assume a different size. Alternatively again, the player may drag one corner of the window for resizing it. The player may change the transparency of the meters window by pressing the "Opacity" button 910, whereupon a menu may pop-up offering various opacity values. Alternatively, the meters window may assume a different opacity each time the button 910 is pressed. Similarly, other buttons or interaction means may be offered for changing the presentation style or skin of the meters window. The meters windows may be docked (i.e. locked anchored or pinned) at a particular location and be prevented from being closed or minimized by pressing the "pin" button 906. Other interaction means may be provided, to afford both players and operators great latitude in customizing the appearance of the game. For example it may be desirable to apply the same window control concepts to other types of windows and gadgets available to the player during a game session; consequently all graphics objects may be given the same capabilities, without limitation, of moving, docking, resizing, opacity, minimizing and skin/style change.

It is to be noted that one or more of the interaction means and elements of FIG. 9 may form part of a management console of a central computer system (1556 in FIG. 15). Such a management console may be configured to enable policies to be interactively set (by a game operator, regulatory official, an employee of a gaming facility in which the gaming machine is located, by another person or programmatically) for controlling the layout of one or more of the plurality of graphic objects on the display(s) of the gaming machine. Such interactively set policies may be enforced by the central system 1556 to one or more gaming machines coupled thereto. Such a management console may be operative to control the layout, appearance (and optionally other attributes) of one or more of the graphic objects displayed on the display(s) of selected ones or all of the gaming machines that are connected to the remote central computer system 1556.

Figure 10:
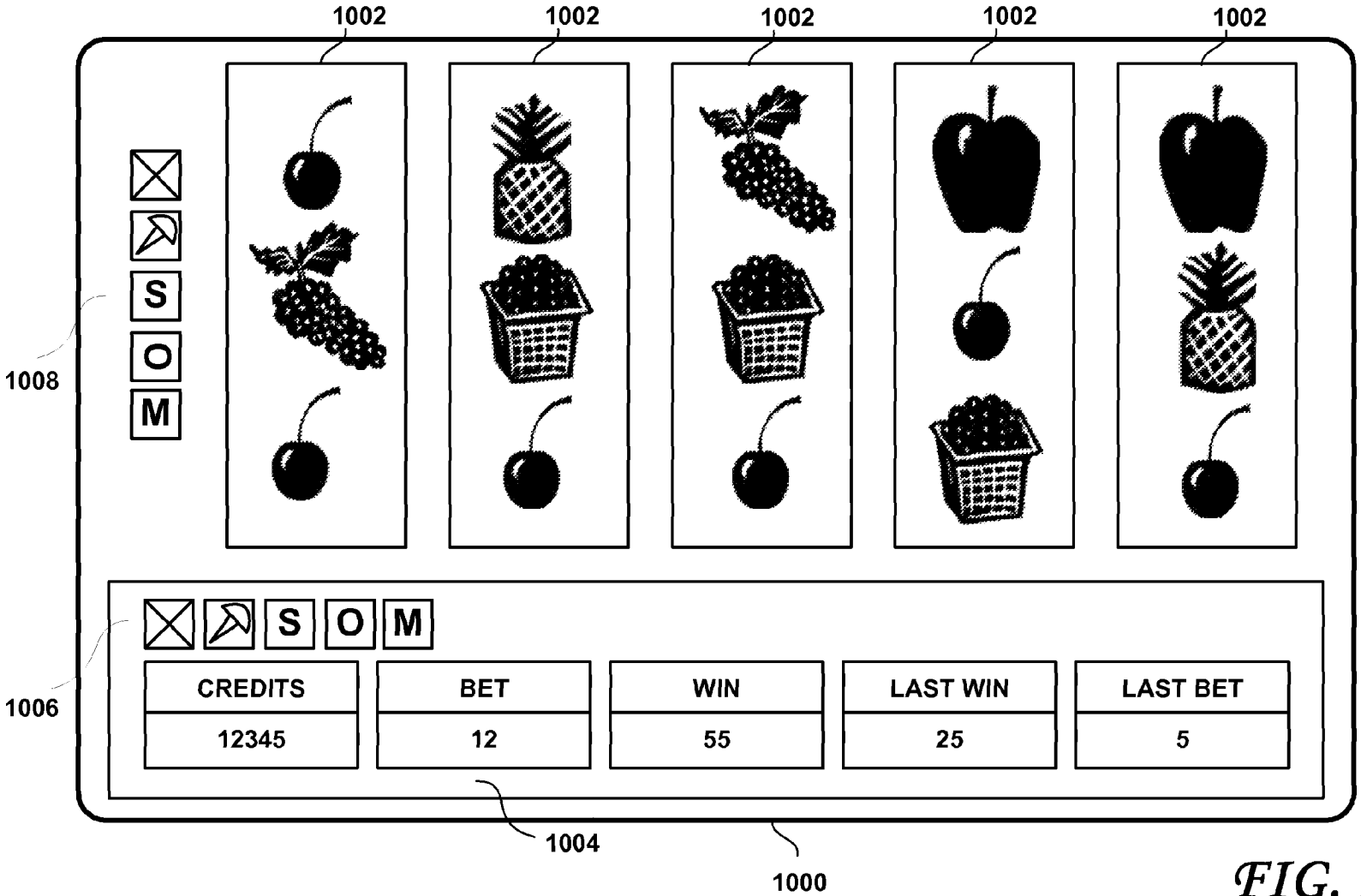
FIG. 10 illustrates meters docking on a game display and partitioning of controlling software, according to an embodiment of the invention.

FIG. 10 shows two groups of graphic objects on a single video panel 1000 that may be controlled interactively by the player or centrally by the game operator, according to further embodiments of the present invention. The appearance of spinning wheels 1002 may be controlled by the buttons 1008. The appearance for the meters window 1004 may be controlled by the buttons 1006.

Each group of graphic objects may be controlled by a separate controlling process executing in a process sandbox. As an immediate benefit, the software controlling each group of graphic objects may be controlled by a partitioned software having a well defined application programming interface (API) developed by an independent software group or software vendor. The end-to-end security principles described in the commonly assigned and co-pending patent application Ser. No. 10/520,831, filed Jan. 5, 2005, entitled "Secure Game Download," and commonly assigned and co-pending patent application Ser. No. 10/789,975, filed Feb. 27, 2004, entitled "Dynamic Configuration of a Gaming System" may be fully applied. Both of the aforementioned patent applications are hereby incorporated herein by reference in their entirety. In addition, the modular principles described in commonly assigned U.S. Pat. No. 6,916,247, entitled "Modular Entertainment And Gaming Systems", commonly assigned U.S. Pat. No. 6,908,391, entitled "Modular Entertainment And Gaming System Configured To Boot Its Operating System And/Or Application Software From A Remote Device," commonly assigned and co-pending application Ser. No. 10/120,635, filed Apr. 10, 2002, entitled "Modular Entertainment And Gaming Systems Configured To Consume And Provide Network Services," and U.S. Pat. No. 6,945,870, entitled "Modular Entertainment And Gaming System Configured To Capture Raw Biometric Data And Responsive To Directives From A Remote Server," may be applied to great advantage and the controlling process for a particular group of graphic objects may be controlled by a process located in a central computer (such as shown at reference numeral 1556 in FIG. 15) or another peer computer (such as shown at 1558 in FIG. 15) that is coupled to the gaming machine. Peer-to-peer principles as such detailed in commonly assigned and co-pending patent application Ser. No. 11/172,518, filed Jun. 29, 2005, entitled "Universal Peer-To-Peer Game Download," application Ser. No. 11/456,528, filed Jul. 10, 2006, entitled "Multi-Player Regulated Gaming With Consolidated Accounting," application Ser. No. 11/354,568, filed Feb. 14, 2006, entitled "Methods And Systems For Implementing A Secondary Game Across A Plurality Of Gaming Machines," application Ser. No. 10/520,831, filed Apr. 10, 2002, entitled "Secure Game Download," and in commonly assigned U.S. Pat. No. 6,645,075, entitled "Cashless Time Gaming," and U.S. Pat. No. 6,916,244, entitled "Server-Less Cashless Gaming Systems And Methods," all applications and patents of which are hereby incorporated by reference herein in their entireties, may also be applied to great advantage. This modular approach may encourage freelance software developers to specialize in some sophisticated and engaging game add-ons or plug-ins and offer them to gaming machine vendors to add to their game software. For example, a player tracking module developed by company X may comprise a central control module located in a central server (such as shown at 1556 in FIG. 15) on the gaming network that directly and securely controls a graphics gadget on each gaming machine via .NET Remoting, RPC or other IP service. Likewise, company Y may specialize in offering "skin-able meters" plug-ins that provides a wide range of presentation themes and dazzling 3D animations and sounds. The game designer may decide at game design time on a suitable meters presentation, or alternatively, the player and the game operator may be given the option to select a presentation or skin, without requiring the game software to undergo a lab test and recertification.

Figure 11:
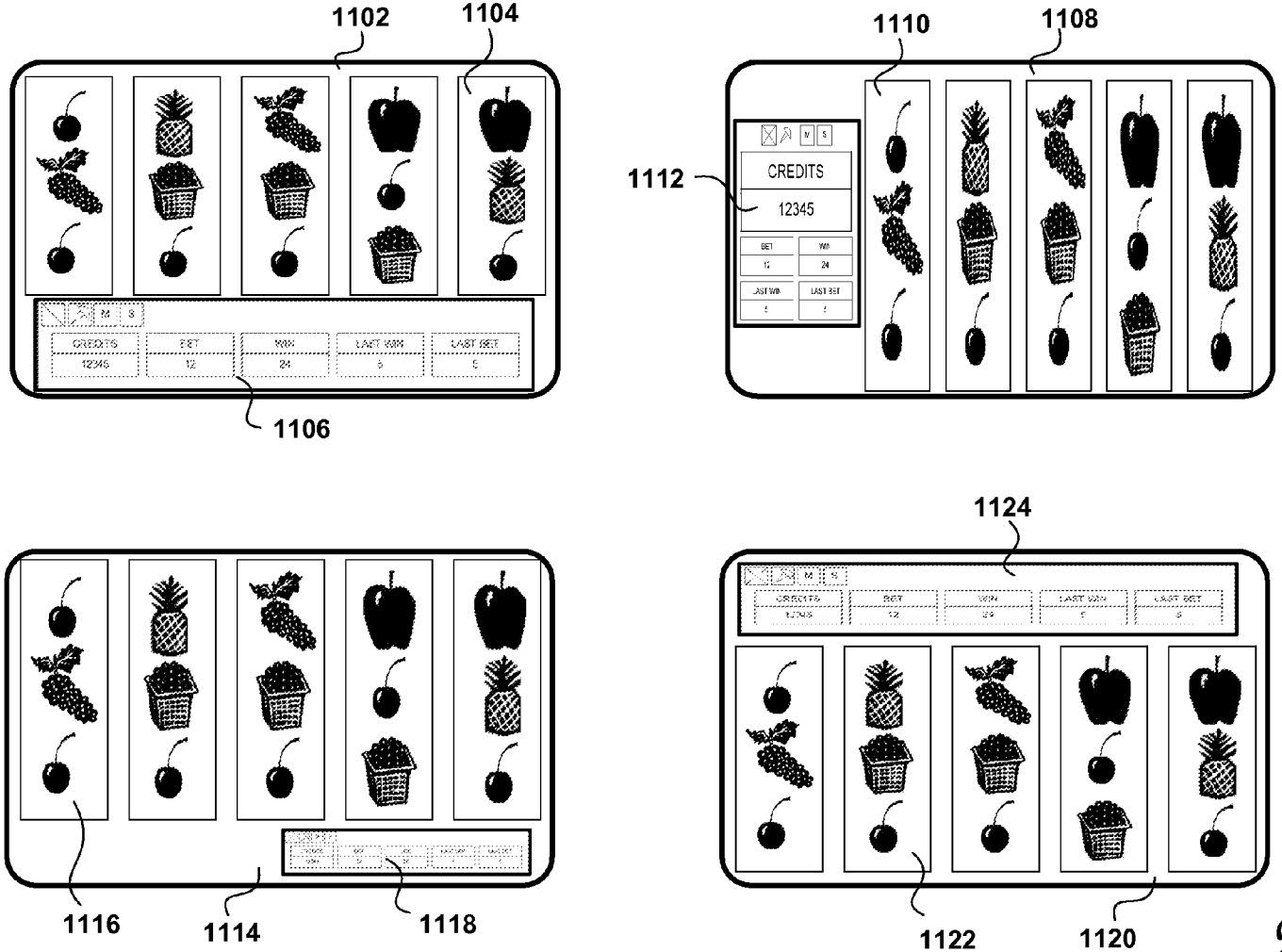
FIG. 11 illustrates the possible docking arrangements that player may choose, according to an embodiment of the invention.

FIG. 11 illustrates exemplary arrangements of the graphic objects that a player or an operator may choose, according to further aspects of embodiments of the present invention. On display 1102, the group of spinning wheels 1104 is on the top and the meters 1106 are on the bottom. On display 1108, the group of spinning wheels 1110 is on the right and the meters 1112 are on the left. On display 1114, the group of spinning wheels 1116 is on the top and the meters 1118 are on the bottom left in reduced size. On display 1120, the group of spinning wheels 1122 is on the bottom and the meters 1124 are on the top.

Figure 12:
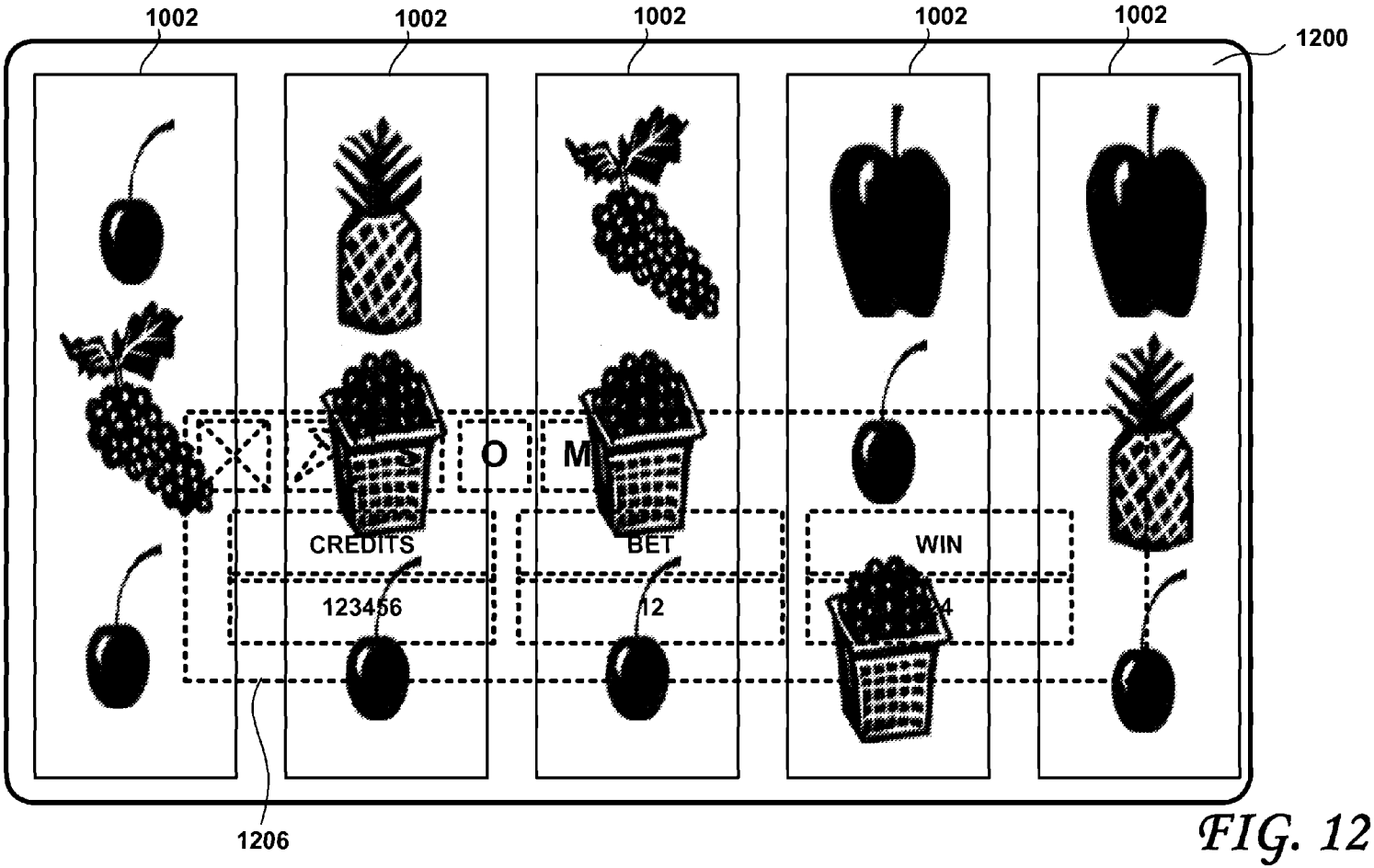
FIG. 12 illustrates meters rendered with controlled transparency, according to an embodiment of the invention.

Alternatively and as shown in FIG. 12, the group of spinning wheels 1202 may occupy the overall space across the video display 1200 and the meters 1204 are rendered with a predetermined transparency over the wheels. Indeed, the transparency may vary from full transparency to fully opaque. Moreover, the size thereof may vary from large to small, under software control at different moments within the gaming session.

Figure 13:
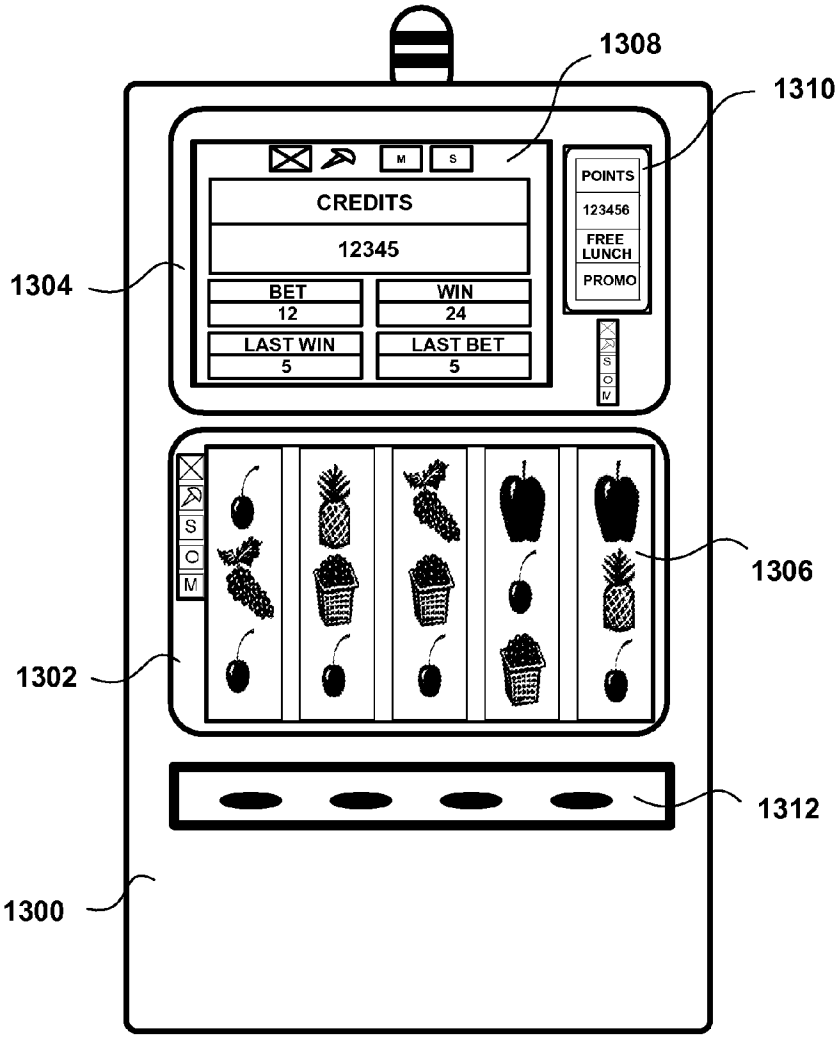
FIG. 13 illustrates gaming area and meters docked on different windows panels, according to an embodiment of the invention.

FIG. 13 shows an exemplary player-selectable arrangement of the graphic objects on a dual display gaming machine 1300. As shown, the group of spinning wheels 1306 takes the overall space across the lower video display 1302 and the meters 1308 may be combined with a player tracking interface 1310 across the upper video display 1304. The player or the game operator may choose other arrangements depending on the number of configurable or skin-able graphics objects and the number and sizes of the video displays available on the gaming machine.

Figure 14:
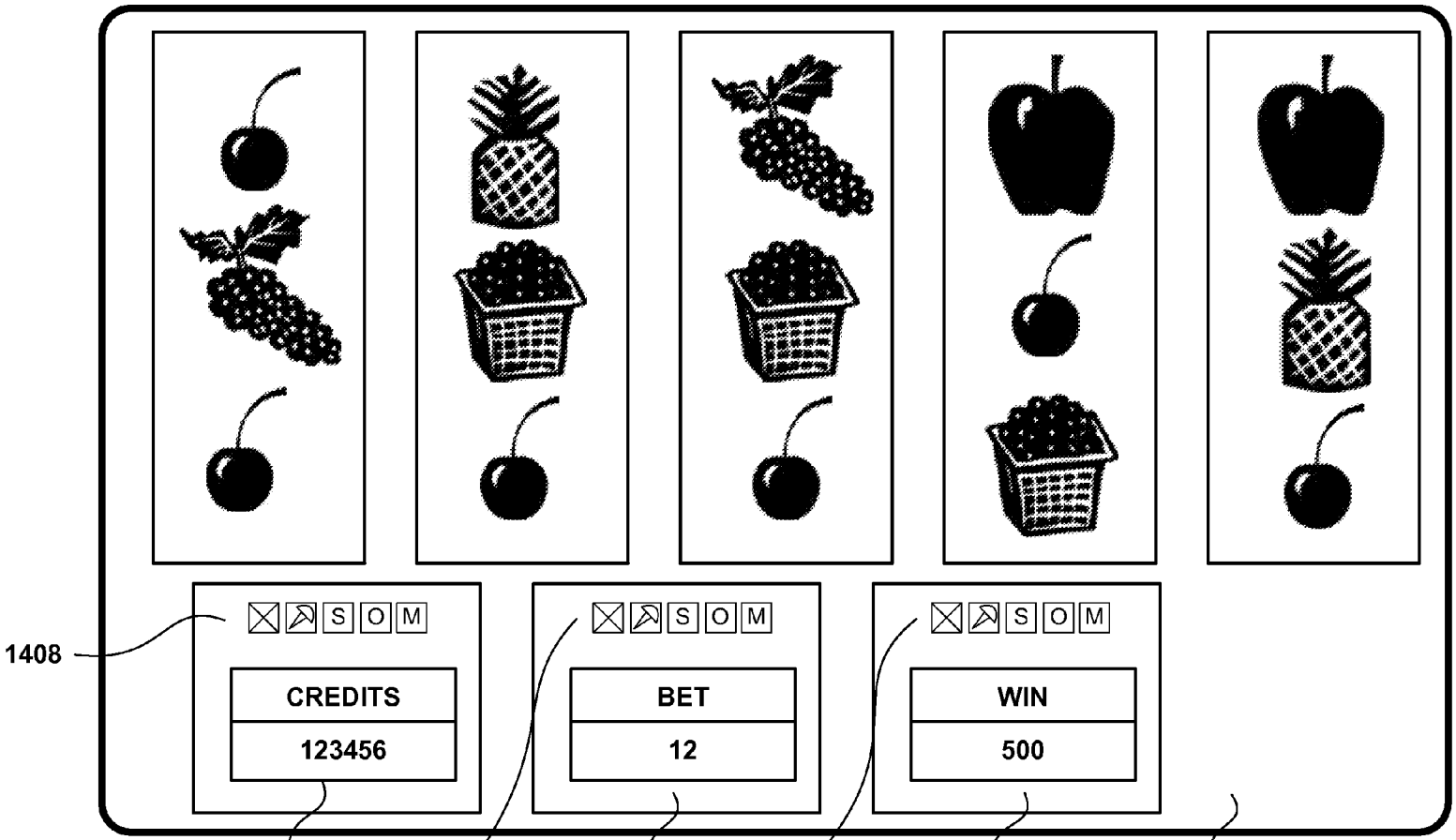
FIG. 14 illustrates individual docking of meters, according to an embodiment of the invention.

FIG. 14 illustrates a further partitioning of the graphic objects of video display 1400 according to further aspects of embodiments of the present invention. As shown, the group of meters may be divided in individual meters 1402, 1404 and 1406, each having the capability to have its appearance controlled by the player via interactive controls means 1408, 1410 and 1412 or via recalling previously stored player profile settings or alternatively by the game operator via central configuration via a suitable management console on a central system 1556.

Later generation graphic platform such as Microsoft Windows Platform Foundation (WPF), WinFX, .NET Framework 3.0 and XNA Game Studio Express for Windows Vista and Windows XP, together with associated new generation of graphic design tools such as Microsoft Expression suite (in which graphics are no longer bound by raster technology but are fully scalable using vector graphics), may allow creative minds to develop dazzling graphics. Microsoft's Visual Studio Express is aiming to democratize application development by putting development tools into the hands of novice and hobbyist programmers. Microsoft officials hope XNA Game Studio Express will democratize game development by delivering the necessary tools to hobbyists, students, independent developers and studios to help them more readily create games for the Xbox 360. This democratization will enable game players to more easily become game developers, company officials said. And by joining a "creators club" for an annual subscription fee of $99, developers will be able to build, test and share their games on Xbox 360 and access other materials to help them develop games for the Microsoft platform, Microsoft said. Code signing each module with an individual certificate would enable end-to-end security throughout the life cycle of the game and ensure that freelance developers are rewarded in accordance with the success of their games or plug-ins. This may be accomplished by examining the audit logs containing a trace of the certificate ID for each module executed. Individual modules of the games (and not the entire game) may be replaced via central download to speed up and reduce cost of ownership.

The virtual display architecture detailed herein accommodates any number and size of display panels that may be fitted or connected to a gaming machine including, but not limited to, large format plasma displays, 3D displays, projection displays and interactive 3D projection displays such as Microsoft "Touchlight" technology that lets users move and manipulate three-dimensional images with their hands. The virtual display architecture detailed herein may also accommodate technologies such as Microsoft's "PhotoSynth", which constructs a user navigable 3-D environment from a plurality of 2-D pictures or technologies such as Total Immersion's D° Fusion technology, which seamlessly blends video and 3-D computer generated constructs and animation together. One or a plurality of displays may be remote from the gaming machine, the remote display being controlled by a network connected controller. Such a display may advantageously be a large size plasma display controlled by a PC or an XBOX 360 game console, for example. The network inter-process communication between the gaming machine and the remote display controlled by a XBOX 360 may use the Microsoft MCML language (Media Center Markup Language) or the Microsoft XNA (http://msdn.microsoft.com/directx/xna/). The network connected remote display may be shared between a plurality of gaming machines, each gaming machine controlling at least one graphic objects via network inter-process connection. The end-to-end secure code download principles using code signing and software restriction policy may be advantageously applied to download the necessary network inter-process code. The virtualization of remote large size advanced technology displays shared between a plurality of gaming machines may allow freelance developers to offer dazzling interactive video billboards driven directly by the games played on the gaming machines. One or a plurality of displays may be remote from the gaming machine, the remote display being controlled by a network connected controller. Such a display may advantageously be a large size plasma display controlled by a PC or, an XBOX 360 game console, a Microsoft media extender or equivalent, for example. The network inter-process communication between the gaming machine and the remote display controlled by a XBOX 360 or media extender may use the Microsoft MCML language (Media Center Markup Language), the Microsoft XNA (http://msdn.microsoft.com/directx/xna/) or the Microsoft "Media Extender" framework, for example. The network connected Media Extender device may an XBOX, a PC, a tablet device, a mobile PC, a palmtop PC, a Windows Smartphone or a wired/wireless media player such the Microsoft "Zune" media player. The network connected remote display may be shared between a plurality of gaming machines, each gaming machine controlling at least one graphic objects via network inter-process connection. The end-to-end secure code download principles using code signing and software restriction policy may be advantageously applied to download the necessary network inter-process code. The virtualization of remote large size advanced technology displays shared between a plurality of gaming machines may allow freelance developers to offer dazzling interactive video billboards driven directly by the games played on the gaming machines. The display virtualization to remote hand-held personal computer devices (e.g. SmartPhone, Zune, etc.) connected to a single gaming machine or shared between a plurality of gaming machines may allow freelance developers to offer visually enticing interactive distributed video billboards driven directly by the games played on the gaming machines.

FIG. 15 is a high-level illustration of a Regulated Gaming Exchange according to an embodiment of the present invention. The present Regulated Gaming Exchange or Gaming Exchange Portal enables (a) freelance game developers 1502 gather intelligence data (e.g., usage metrics) 1534 from players 1526 and other acquired data as described later relative to FIG. 16 such as to offer new and dazzling electronic games 1506 to the gaming marketplace of the regulated casino 1510 and receive compensation as shown at 1522 based on the success of their games based on measured auditing/play metrics 1520 of players 1512 playing the games on the casino gaming machines 1514, and (b) game operators gather intelligence data (such as usage and/or popularity metrics, and other acquired data as described later relative to FIG. 16 for example) 1516 to enables them to tailor their regulated game offerings 1518. Intelligence data (e.g., usage metrics) 1534, 1516 for both the freelance game developers and the game operators are, according to embodiments of the present invention, based on demand/popularity of identical trial games 1506 1538 available to the players 1526 over an Internet portal 1500 through a trial download 1530. As the trial downloaded games (the unregulated first versions of the games) 1530 may use simulated or virtual money only (or no money at all), they are unregulated, as suggested at 1532 by gaming certification lab 1542. In addition, players may be provided, as shown at 1554, with the location of casinos that offer their favorite game(s) and/or other promotions. The games available at the casino (the certified second versions of the games) may include games that may be identical or similar to the downloaded trial games, except the game play thereof may allow for playing with real money or other forms of wagering, may use a certified source of random outcome, may store critical meters on certified non-volatile memory, may provide functionality for player dispute resolution and/or may communicate with a central game management system (such as shown at 1556 in FIG. 15). Such games offered within the casinos or other gaming establishments, contrary to the unregulated downloaded trial games, must be certified by the gaming certification lab 1542. One such certification lab is Gaming Laboratories International, Inc., which certifies submitted game software for compliance against one or more of the following standards: GLI-11 Gaming Devices in Casinos, GLI-12 Progressive Gaming Devices in Casinos or GLI-13 On-Line Monitoring, Control Systems (MCS) and Validation Systems in Casinos and GLI-21 Game Download System.

According to an embodiment of the present invention, players 1526 of the unregulated downloaded trial games may opt to provide information (such as a list of the players' favorite games, for example) to the Gaming Exchange Portal 1500 to enable casino operators and/or select others to offer incentives to attract them to their casino. Alternatively, consent to providing such information may be a pre-condition to downloading and/or playing the trial unregulated games 1536.

Freelance game developers 1502 may enrich the gaming exchange portal 1500 by adapting popular gaming titles 1506 played on PCs or game consoles such as 1508 GameCube, PlayStation and XBOX for play on the floor 1511 of the casino 1510 or by using their experience and expertise to create new unregulated games specifically for the casinos. In this manner, freelance game developers 1502 drive the exchange portal 1500 by adapting popular gaming titles for play on the casino floor or by using their experience and expertise to create new games 1506 specifically for the casino (all games are preferably configured with a standard API). The existing games adapted (with permission) by the freelance developers may originate from the game library of popular console type gaming platforms, such as Microsoft's XBOX or XBOX 360, Sony's Playstation or Nintendo's GameCube (for example), as shown at 1506 or any future gaming system. Games specifically developed for, e.g., the PC or Apple platforms may also be adapted as described above. Alternatively, wholly new games may be developed by the freelance developers. Alternatively still, the makers (or licensees) of such gaming consoles may adapt existing games within their games library in-house in the manner described herein. Once such new or adapted (modified) games are created, the freelance (or in-house) game developers may submit a copy of the new or adapted game along two paths; namely, an unregulated path 1538 and, in cooperation with a licensed game developer 1504 (e.g. Cyberscan, WMS, Bally, etc.), a regulated path 1540.

Such unregulated first versions of games developed by the freelance game developers or others are preferably such that they do not make use of Internet communication and Internet display technologies to execute and play on the home computing device 1528. That is, the unregulated first versions of the games (in contradistinction to the regulated and certified second versions of the same games) preferably do not use Internet communication technologies such as (for example, and without limitation) HTTP Requests, HTTP Replies, cookies and/or Secure Socket Layers (SSL) to play or execute on the player's home computing device 1528 (whether before or after the player has downloaded a copy thereof). Similarly, the unregulated first versions of the games (in contradistinction to the regulated and certified second versions of the same games) preferably do not use Internet display technologies such as (for example and also without limitation) the use of Internet browsers, HTML, Java Scrips, Java applets, Scriptlets, ActiveX controls, plug-ins, pop-ups and/or cookies to ply or operate the games.

In particular, the first outcome-free portion of the unregulated first version of the game is preferably configured to not make use of Internet communication and/or Internet display technologies to execute and play on the home computing device. Similarly, the graphics portions of the unregulated first version of the game is preferably configured to also not make use of Internet communication and/or Internet display technologies to execute and play on the home computing device.

Downloading (but not execution and playing) of the unregulated first versions of games developed by the freelance may, however, make use of Internet communication technologies and Internet display technologies.

Returning now to FIG. 15, once new games are adapted and/or created, game developers 1502 may submit (e.g., upload) a copy of each developed game to the gaming exchange portal 1500 along two paths, an unregulated path 1538, 1536 and a regulated path 1539, 1540, 1544, in cooperation with a licensed game developer 1504 (e.g. Cyberscan, WMS, Bally, etc.) via the appropriate gaming certification laboratory 1542, as required in the appropriate jurisdiction. The freelance game developer may upload separate versions of the developed game for each of a plurality of targeted types of home computing devices. Such computing devices may include, for example, personal computers (which may include, for example, both Windows-based devices and those running a version of an operating system from Apple Computers), game consoles (e.g. XBOX360), portable computers and portable telephones.

According to an embodiment of the present invention, the regulated version of the game submitted along path 1539 1540 comprises the merging of the outcome-free game software of the freelance game developer and the outcome-bearing game software of the licensed game developer that is then submitted to an independent certification lab 1542 to ensure that it meets all gaming and security standards. Once certification is granted, the now certified game 1544 may be loaded into a regulated games repository 1550 of a selectively accessible predetermined computer site (such as a Web site, for example). Gaming machines 1514 located on the floor 1511 of the casino 1510 may then access the certified and regulated games loaded in the regulated games repository 1550 and such games offered to the casino players 1512. As may be required by regulation, the regulated games of the regulated games repository 1550 may be first downloaded to the central system 1556 before being made available to the gaming machines 1514 to allow for a centrally federated enforcement of policies. Alternatively, such certified and regulated games may be made available over a computer network to other computing devices located in other venues (such as hotel rooms or cruise ship staterooms, for example), subject to appropriate security measures and regulatory approval. Suitable means for providing regulated gaming to guest rooms in the hospitality industry are described in commonly assigned and co-pending patent application Ser. No. 11/456,763, filed Jul. 11, 2006, entitled "In-Room Gaming", which is hereby incorporated herein by reference in its entirety.

As shown in FIG. 15, the unregulated version of the game 1538 may be loaded as a shadow copy in a shadow repository 1548 of the regulated games repository 1550 from which players 1526 at home may download it as shown at 1530 for trial play on their home computers 1528 using an internet connection. Such games may be similar or substantially identical to the games submitted for certification, but for the aspects thereof concerned with money (including the source of randomization used to determine the outcome of the game which may be different in the regulated version of the game than it is in the unregulated version thereof). For example, the two versions of the game may look and play exactly (or nearly exactly) the same. In a preferred embodiment of the invention, the source code of the freelance code for the regulated version of the software and for the unregulated version of the software are substantially identical at least for the code related to providing the dazzling entertaining scenes. For example, if both the gaming machine and the home computer use the PC architecture running under Microsoft Windows, then the source code for both versions of the freelance software (for the regulated game software and for the unregulated game software) may be substantially identical using the same (for example) C# code. Alternatively, if the gaming machine uses the PC architecture running under Microsoft Windows and the home computer uses the XBOX 360, then the source code of the freelance software for both versions (for the regulated game software and for the unregulated game software) may be substantially identical using Visual Studio and XNA Game Studio Express. Alternatively again, if the gaming machine outcome-free entertaining software executes on the XBOX 360 and the home computer uses the PC architecture runs under Microsoft Windows, then the source code of the freelance software for both versions (for the regulated game software and for the unregulated game software) may be substantially identical using (for example) Visual Studio and XNA Game Studio Express. In contrast, some conventional gaming systems make gaming software available for download by players on their home PC. However, such gaming software that is available for download is for evaluation only and does not use the same source code for the non-regulated version of the gaming software as for the regulated version thereof. For example, the non-regulated version of such conventional downloaded evaluation gaming software may execute in a web-browser, while the regulated version of conventional gaming software may execute in a proprietary graphic shell.

In direct contrast, a player of an unregulated game according to embodiments of the present invention downloaded from the exchange 1500 onto his or her home computer or home computing device 1528 (which may include a branded gaming console) will have much the same gaming experience when he or she plays at home as when he or she plays the regulated and certified version of the same game on a regulated gaming machine in a casino or other gaming establishment (but for the wagering aspects of the game which, on the regulated gaming machine, include playing for real money or other tangible value). Usage metrics 1534 from this process may be used to structure game offering menus on the casino floor 1511 such that the most popular gaming titles are front-loaded.

On the floor 1511 of the casino 1510, each gaming machine 1514 records its regulatory meters from which usage metrics 1520 of gaming titles may be derived. An embodiment of the invention may rely on code-signing of game code according to the principles set out in the commonly assigned and co-pending patent application Ser. No. 10/520,831, filed Aug. 12, 2005, entitled "Secure Game Download", which is hereby incorporated herein by reference in its entirety. A trusted audit trail may also be splashed in the event log. Embodiments of the present invention may allocate an individual PKI certificate to each executable software component of the certified and regulated games and to each of their versions, binding the PKI certificate to the executable software and associating a distinctive policy for each PKI certificate. The PKI certificate's "Subject Name" (or "Issued to" field, or "Common-Name" field) may be a concatenation of the software component identification, its version number and optionally other identification characters, for example. In this manner, the "subject name" may also comprise an embedded secure license identifier of the developer for license tracking. Therefore, examination of the game audits reveals the detailed metrics 1520 of each played game and statistics may be generated in order to reward the freelance game developers 1502 with financial compensation as shown at 1522 in accordance with the popularity of their games. Thanks to End-to-End Download Security and Embedded Secure License Identifiers, developers will receive financial compensation in accordance with game success.

A new game submitted along path 1540 may include outcome-free code and outcome-bearing code. The outcome-free code may be developed by the freelance game developers 1502 and the outcome-bearing code may be developed by the supplier game developers 1504, as detailed above. It is to be understood that variations are possible, as those of skill in this art may appreciate. For example, embodiments of the present invention provide for both the outcome-free code and the outcome-bearing code being developed by the same entity, be it the freelance code developers or the supplier game developers. In order to be permitted to enter the regulatory certification cycles, the supplier game developers may take delivery of the outcome-free code developed by the freelance game developers 1502 and may submit the entire code that makes up the new game submitted along path 1540 (i.e., the outcome-free code and the outcome-bearing code) to the certification lab 1542. The outcome-free code may include code that need not be submitted to the certification lab 1542 in source code form. The outcome-bearing code (and the outcome-free code, if needed) may be submitted to the certification lab 1542 in any manner or may be submitted as disclosed in commonly assigned and co-pending patent application Ser. No. 11/251,628, filed Oct. 14, 2005, entitled "Universal Method For Submitting Gaming Machine Source Code Software To A Game Certification Laboratory", which is hereby incorporated herein by reference in its entirety.

Although less secure than the "compartmented" freelance code described earlier in this specification, another embodiment of the present invention may include submitting to the certification lab an outcome-determining-free game software that includes only graphic rendering code, such as macromedia .swf files for example. Although .swf files do render outcome graphically (i.e. may render a winning number on the video display in response to a provided outcome code) via a Macromedia flash players installed in the gaming machines and in the home computer devices, they do not determine the outcome. The outcome determining game software is a separate code that is developed by the licensed game developer and that is submitted to the gaming software certification laboratory in source code form. The .swf files are derived from the Macromedia Director Studio (a graphic animation studio), are not produced directly by a human programmer and are not directly executable (can only be rendered via a Flash player, noting that the Flash player does not necessary require an Internet web browser to render graphic animations). Consequently, the gaming software certification laboratory may not examine any outcome-determining-free source code. A freelance developer may provide .swf outcome-determining-free files (or equivalent from a different graphic animation studio) for the purpose of the regulated gaming exchange invention described herein. The outcome-determining-free approach is notably adopted by Cyberscan in UK and early deployments in USA for their regulated gaming machines.

The regulated new game 1544 certified by the lab 1542 may be transferred to the gaming exchange portal 1500 in a "regulated games repository" 1550 that contains a plurality of regulated games available for download to authorized parties. A copy of a regulated game 1518 may be downloaded from the regulated games repository 1550 by an operator of the casino 1510 for deployment in the gaming machines 1514 of the casino 1510 after determining (from the usage and popularity metrics 1516, for example) that this game is likely a good fit in his casino for a predetermined profile of players. In turn, the operator of the casino 1510 may send promotional information 1554 (such as casino locations carrying the new game and vouchers) to the gaming exchange portal 1500, to enable the promotional information to be forwarded to the appropriate players 1526 via email or other channels in accordance, for example, with the usage metrics 1534 obtained from the registered players 1526 and their contacts details and preferences 1552, as such players have previously played the unregulated trial version of the game 1530 1532, on their home computers 1528, for example.

The gaming exchange portal 1500 may be configured to deploy policies such as active directory policies (or equivalent ADM policy scripts) to the player's home computer 1528 such as to enforce software installation policies (SIP) and software restriction policies (SRP) in accordance with the principles detailed in commonly assigned and co-pending patent application Ser. No. 10/789,975, filed Feb. 27, 2004, entitled "Dynamic Configuration Of A Gaming System", which is hereby incorporated herein by reference in its entirety, in order to offer the player some confidence that the origin of the software is from a reputable source, to ensure proper updating of new game software components and to revoke obsolete game software components. Policies may be used to ensure the proper localization variant of the game is executed by the player in accordance with local regulation. Indeed, the player may choose the localization variant of the applicable state where he wishes to try the game or play (for real money or other value) at his or her preferred casino.

A player 1526 playing his or her favorite game on his home computer 1528 may select various presentation preferences such as those described above for "Virtual Display" and store his or her preferences in a player profile, on a local storage or on the gaming exchange portal 1500. When the player 1526 travels to a casino 1510, the player may play his favorite game on a gaming machine 1514 and may also retrieve his or her preferences from the stored player profile. In this manner, the game played on the gaming machine 1514 within the casino 1510 (or other location) appears as it did on his or her home computer 1528—that is, with his or her preferences incorporated in the displayed graphics of the game and/or game play.

Figure 16:
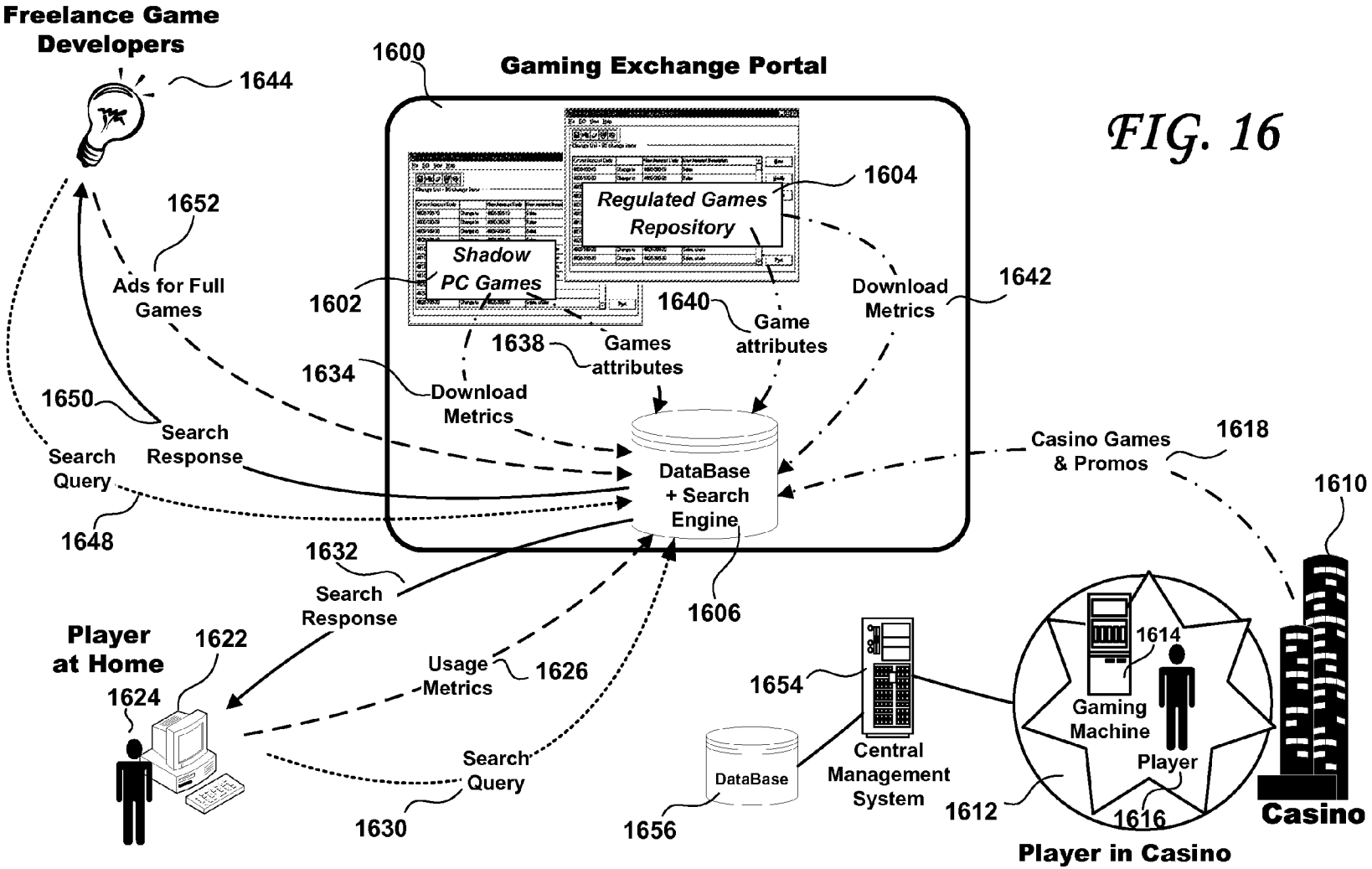
FIG. 16 illustrates the architecture of a search portal, according to an embodiment of the invention.

FIG. 16 is a high-level illustration of search means for the Regulated Gaming Exchange Portal, according to an embodiment of the present invention. Thanks to the compartmented approach described above in this document that allows freelance developers to offer dazzling games, it is anticipated that the regulated gaming exchange portal will rapidly contain thousand of games and game variants. Therefore, search means are desirable. The Gaming Exchange Portal 1600 may further include a database and search engine means 1606 similar to the ubiquitous Google. In fact, the database and search engine means may be a "Search Appliance" purchased for example from Google (http://www.google.comienterprise/gsa/index.html) or from another party. The Search Appliance may crawl and scan the content of the gaming exchange portal and create a master index of information that is ready for instant retrieval using Google-like (for example) search technology whenever a player 1624, a freelance developer 1644 or a game operator 1610 types in a search query. The Search Appliance can index millions documents, and its security features ensure that users can only access the information that they have permission to view. The scanned documents may be the player help files that contain the information displayed to the player 1616 on the regulated gaming machines 1614 upon pressing the help menu, associated information available in XML files or other specifically prepared game specification documents. For each game software, the information may comprise attributes 1638 1640 such as the game type (e.g. fruit type X, poker type Y, etc. . . . ), the game theme (e.g. English, Chinese, Christmas, Easter, Birthday, Marriage, beginner, advanced, etc.), the return to player (RTP) factor (e.g. 92%, 94%, 98%), the denomination (e.g. 1¢, 5¢, 10¢, 50¢, $1, $10, $50) and the volatility (e.g. high, low, medium, that is win small amounts frequently or win larger amounts less often). In addition to the usage metrics 1534 1626, the database may keep statistics on the frequency of download for each game 1634 1640 and the geographic distribution (using geographic intelligence based on the IP number of the home PC 1622).

Advertising sensing technology may be implemented such as Google AdSense as a fast and easy way for game operators and freelance developers to display relevant ads on their result content pages to offer home players an opportunity to follow links to examine casino promotions 1618 and freelance full size unregulated version of the games 1652. The history of the queries 1630 of each player combined with their usage metrics 1626 may be analyzed to derive intelligence therefrom relative to their preferences, such that the ads and associated links may be tailored according to what the visiting players are looking for.

The database and search engine 1606 may also contain the player profiles 1552 and queries may be formulated to derive intelligence on the most popular player profiles.

The players at home 1624 may formulate a search query 1630 by entering selected game attributes via a search page which is forwarded to the database and search engine 1606. The search engine 1606 may then return a search response 1632 to the player. Freelance developers 1644 may also formulate a search query 1648 by entering selected game attributes via a search page which is forwarded to the database and search engine 1606. The search engine 1606 would then returns a search response 1650. Similarly, the game operator 1610 may formulate search queries and get search responses. A player 1616 on the casino floor 1612 may formulate search queries and obtain search responses whenever the casino operator 1610 provides facilities to access the game exchange portal search engine 1606. Access may be provided to the players directly via the gaming machine 1614 or via auxiliary consoles disposed on the casino floor.

The gaming operator 1610 may, for security reasons, provide an internal database and search engine 1656 connected to the central management system 1654 that provides the same functions as the external database and search engine 1606, and allow the players 1616 to formulate queries related to games and promotions.

While the foregoing detailed description has described preferred embodiments of the present invention, it is to be understood that the above description is illustrative only and not limiting of the disclosed invention. Those of skill in this art will recognize other alternative embodiments and all such embodiments are deemed to fall within the scope of the present invention. Thus, the present invention should be limited only by the claims as set forth below.

What is claimed is:

1. A method of developing and distributing a game, comprising the steps of:

developing a first outcome-free game portion;

developing a first outcome-bearing game portion that is configured to be played without wagering or that is configured to enable wagering using only virtual money, that is associated with the developed first outcome-free game portion and that is configured to show an outcome of the unregulated first version of the game;

merging the first outcome-free game portion and the first outcome-bearing game portion to obtain an unregulated first version of the game such that at least a portion of the first outcome-bearing game portion is shown during game play in synchronism with and superimposed on or under the first outcome-free game portion;

providing at least one server and carrying out a first making step to make the unregulated first version of the game available for download from the at least one server to at least one home computing device;

developing a second outcome-free game portion that is substantially identical to the first outcome-free game portion;

developing a second outcome-bearing game portion that is configured to enable wagering using real money, that is associated with the developed second outcome-free game portion and that is configured to show an outcome of the regulated second version of the game;

merging the second outcome-free game portion and the second outcome-bearing game portion to obtain a regulated second version of the game to be submitted to a gaming software certification laboratory, the merging being carried out such that at least a portion of the second outcome-bearing game portion is shown during game play in synchronism with and superimposed on or under the second outcome-free game portion;

obtaining certification of the regulated second version of the game from the gaming software certification laboratory, and a second making step to make the regulated second version of the game available for download from the at least one server into at least one regulated gaming machine.

2. The method of claim 1, wherein the obtaining step is carried out such that source code of the second outcome-free game portion is not submitted to the gaming software certification laboratory.

3. The method of claim 1, wherein the developing steps are carried out such that the unregulated first version of the game is configured to not make use of Internet communication and Internet display technologies to execute and play on the home computing device.

4. The method of claim 3, wherein the Internet communication technologies include at least one of an HTTP Request, an HTTP Reply, a cookie and a Secure Socket Layer (SSL).

5. The method of claim 3, wherein the Internet display technologies include at least one of an Internet browser, HTML, a Java script, a Java applet, a Scriptlet, an ActiveX control, a plug-in, a pop-up and a cookie.

6. The method of claim 1, wherein the developing steps are carried out such that the first outcome-free portion of the unregulated first version of the game is configured to not make use of Internet communication and Internet display technologies to execute and play on the home computing device.

7. The method of claim 1, wherein the developing steps are carried out such that a graphics portion of the unregulated first version of the game is configured to not make use of Internet communication and Internet display technologies to execute and play on the home computing device.

8. The method of claim 1, wherein the first making step is carried out such that after the unregulated first version of the game is downloaded to the home computing device, the unregulated first version of the game does not make use of Internet communication and Internet display technologies to execute and play on the home computing device.

9. The method of claim 1, wherein the developing steps are carried out such that the first outcome-free game portion of the unregulated first version of the game is identical to the second outcome-free game portion of the regulated second version of the game.

10. The method of claim 1, wherein the developing steps are carried out such that source code of the first outcome-free game portion of the unregulated first version of the game is substantially identical to source code of the second outcome-free game portion of the regulated second version of the game.

11. The method of claim 1, wherein the developing steps are carried out such that source code of the first outcome-free game portion of the unregulated first version of the game is identical to source code of the second outcome-free game portion of the regulated second version of the game.

12. The method of claim 1, wherein the developing steps are carried out such that executable code of the first outcome-free game portion of the unregulated first version of the game is substantially identical to executable code of the second outcome-free game portion of the regulated second version of the game.

13. The method of claim 1, wherein the developing steps are carried out such that executable code of the first outcome-free game portion of the unregulated first version of the game is identical to executable code of the second outcome-free game portion of the regulated second version of the game.

14. The method of claim 1, wherein the first making step includes uploading the unregulated first version of the game into a first repository that is selectively accessible from a predetermined computer site over a computer network and wherein the second making step includes uploading the regulated second version of the game into a second repository that is selectively accessible through the predetermined computer site.

15. The method of claim 14, wherein the predetermined computer site includes an Internet portal.

16. The method of claim 14, further comprising a step of making the predetermined computer site accessible to a plurality of operators of regulated gaming machines.

17. The method of claim 14, further comprising a step of making the predetermined computer site accessible to a plurality of freelance game developers.

18. The method of claim 14, further including the step of making the regulated second version of the game available for download by a plurality of operators of regulated gaming machines from the predetermined computer site.

19. The method of claim 14, further comprising a step of enabling uploads of unregulated first versions of games to the predetermined computer site.

20. The method of claim 14, wherein the gaming exchange further comprises a database and a search engine, and wherein the method further includes a step of the search engine receiving search queries from at least one of the home player, the game operator and the game developer and retrieving data from the database.

21. The method of claim 20 wherein the search engine further carries out steps of crawling the first and second repositories, generating at least one index of a plurality of documents found during the crawling step that contain human readable game information for each game, and recording the at least one index into the database.

22. The method of claim 20, further comprising a step of recording in the database, and making available to the search engine, at least one of usage metrics of players, promotions offered by casinos, list of games offered by casinos, advertising offered by freelance developers, attributes of the games available in the gaming exchange and download metrics.

23. The method of claim 1, wherein the developing steps are carried out such that a source of randomization used in the unregulated first version of the game is different than a source of randomization used in the regulated second version of the game.

24. The method of claim 1, wherein the developing steps are carried out such that the unregulated first version of the game is configured to store critical meters in a different type of non-volatile storage media than is the regulated second version of the game.

25. The method of claim 1, wherein the developing steps are carried out such that an executable code of the unregulated first version of the game is configured to store critical meters in a different type of non-volatile storage media than is an executable code of the regulated second version of the game.

26. The method of claim 1, wherein the developing steps are carried out such that the unregulated first version of the game is substantially identical to the regulated second version of the game, except that the regulated second version of the game at least one of (a) allows for wagering using real money, (b) uses a certified source of random outcome, (c) stores critical meters on certified non-volatile memory, (d) provides functionality for player dispute resolution and (e) communicates with a central game management system.

27. The method of claim 1, wherein the developing steps are carried out such that a source code of the unregulated first version of the game is substantially identical to a source code of the regulated second version of the game, except that the source code of the regulated second version of the game at least one of (a) allows for wagering using real money, (b) uses a certified source of random outcome, (c) stores critical meters on certified non-volatile memory, (d) provides functionality for player dispute resolution and (e) communicates with a central game management system.

28. The method of claim 1, wherein the developing steps are carried out such that each software component of the unregulated first version of the game is code-signed with a unique certificate and wherein the home computing device is configured with associated software restriction policies.

29. The method of claim 1, wherein the developing steps are carried out such that each software component of the regulated second version of the game is code-signed with a unique certificate and wherein the regulated gaming machine is configured with associated software restriction policies.

30. The method of claim 1, further comprising a step of receiving usage metrics of game play of the unregulated first version of the game played on the home computing device.

31. The method of claim 30, further comprising steps of storing the received usage metrics on a predetermined computer site and making the stored usage metrics available to at least one of an operator of the regulated gaming machine, a developer of the regulated second version of the game, a developer of the first and second outcome-free game portions and a developer of the unregulated first version of the game.

32. The method of claim 31, further comprising a step of the operator of the regulated gaming machine selecting at least one regulated second version of the game for download to at least one regulated gaming machine in accordance with the usage metrics.

33. The method of claim 31, further comprising a step of configuring the predetermined computer site such that the stored usage metrics are selectively available to operators of regulated gaming machines.

34. The method of claim 31, further comprising a step of configuring the predetermined computer site such that the stored usage metrics are selectively available to freelance game developers.

35. The method of claim 31, further comprising a step of configuring the predetermined computer site such that the stored usage metrics are selectively available to players playing on their home computing devices.

36. The method of claim 1, further comprising a step of receiving contact details of a player of the unregulated first version of the game.

37. The method of claim 1, further comprising a step of receiving a preference profile of a player of the unregulated first version of the game.

38. The method of claim 37, further comprising a step of sending the preference profile of the player of the unregulated first version of the game to the gaming machine.

39. The method of claim 38, further comprising a step of enabling the regulated second version of the game to be configured according to the preference profile.

40. The method of claim 1, further comprising a step of modifying the first outcome-free game portion of the unregulated first version of the game in accordance with the usage metrics.

41. The method of claim 1, further comprising a step of sending promotional information to players of the unregulated first version of the game having provided their contact details.

42. The method of claim 1, further comprising a step of sending a notice of availability of the regulated second version of the game on regulated gaming machines to players of the unregulated first version of the game.

43. The method of claim 1, wherein the home computing device is one of a personal computer (PC), a mobile computer and a game console.

44. The method of claim 1, further comprising steps of:

code signing with a unique certificate each software component of the second outcome-free game portion that is merged into the regulated second version of the game, maintaining a list of the unique certificates associated with the second outcome-free game portion developed by at least one freelance developer, producing an audit log of regulated second versions of the game played on the regulated gaming machine, the audit log containing traces of the unique certificates recorded when each code signed software component is executed, and deriving usage metrics of played regulated second versions of the game from the audit logs using the traces of the unique code signing certificates.

45. The method of claim 44, further comprising a step of maintaining an accounting of an amount to pay the at least one freelance game developer according to the derived usage metrics.

46. A gaming system, comprising:

a first server including a first processor, the first server being coupled to a first repository that is selectively accessible to home players over a computer network, the first repository storing at least one unregulated first version of a game that is configured for game play on home computing devices, the first server being configured to communicate, using the first processor, the first version of the game to the home computing devices over the computer network, the at least one unregulated first version of the game being uncertified by a gaming software certification laboratory and including a first outcome-free game portion and a first outcome-bearing game portion, the at least one unregulated first version of the game being configured to be played without wagering or to enable wagering only with virtual money;

a second server including a second processor, the second server being coupled to a second repository that is selectively accessible over the computer network to operators of regulated gaming machines, the second repository storing at least one regulated second version of the game that is configured for game play on regulated gaming machines, the second server being configured to communicate, using the second processor, the at least one regulated second version of the game to the regulated gaming machines over the computer network, the at least one regulated second version of the game being certified by the gaming software certification laboratory and including a second outcome-free game portion and a second outcome-bearing game portion, the at least one regulated second version of the game being configured to enable wagering with real money, the second outcome-free game portion being substantially identical to the first outcome-free game portion, the second regulated version of the game being configured such that at least a portion of the second outcome-bearing game portion is shown during game play in synchronism with and superimposed on or under the second outcome-free game portion.

47. The gaming system of claim 46, wherein source code of the second outcome-free game portion is not submitted to the gaming software certification laboratory.

48. The gaming system of claim 46, wherein the at least one unregulated first version of the game is configured to not make use of Internet communication and Internet display technologies to execute and play on the home computing device.

49. The gaming system of claim 48, wherein the Internet communication technologies include at least one of an HTTP Request, an HTTP Reply, a cookie and a Secure Socket Layer (SSL).

50. The gaming system of claim 48, wherein the Internet display technologies include at least one of an Internet browser, HTML, a Java script, a Java applet, a Scriptlet, an ActiveX control, a plug-in, a pop-up and a cookie.

51. The gaming system of claim 46, wherein the first outcome-free portion of the at least one unregulated first version of the game is configured to not make use of Internet communication and Internet display technologies to execute and play on the home computing device.

52. The gaming system of claim 46, wherein a graphics portion of the at least one unregulated first version of the game is configured to not make use of Internet communication and Internet display technologies to execute and play on the home computing device.

53. The gaming system of claim 46, wherein the at least one unregulated first version of the game is configured to not make use of Internet communication and Internet display technologies to execute and play on the home computing device.

54. The gaming system of claim 46, wherein the first outcome-free game portion of the at least one unregulated first version of the game is identical to the second outcome-free game portion of the at least one regulated second version of the game.

55. The gaming system of claim 46, wherein source code of the first outcome-free game portion of the at least one unregulated first version of the game is substantially identical to source code of the second outcome-free game portion of the at least one regulated second version of the game.

56. The gaming system of claim 46, wherein source code of the first outcome-free game portion of the at least one unregulated first version of the game is identical to source code of the second outcome-free game portion of the at least one regulated second version of the game.

57. The gaming system of claim 46, wherein executable code of the first outcome-free game portion of the at least one unregulated first version of the game is substantially identical to executable code of the second outcome-free game portion of the at least one regulated second version of the game.

58. The gaming system of claim 46, wherein executable code of the first outcome-free game portion of the at least one unregulated first version of the game is identical to executable code of the second outcome-free game portion of the at least one regulated second version of the game.

59. The gaming system of claim 46, wherein the first repository and the second repository are selectively accessible at a predetermined computer site.

60. The gaming system of claim 59, wherein the predetermined computer site includes an Internet portal.

61. The gaming system of claim 59, wherein the predetermined computer site includes promotional information to be sent to players of the at least one unregulated first version of the game having provided their contact details.

62. The gaming system of claim 59, wherein the predetermined computer site includes a notice of availability of the at least one regulated second version of the game on regulated gaming machines to be sent to players of the at least one unregulated first version of the game.

63. The gaming system of claim 59, wherein the predetermined computer site is selectively accessible to a plurality of operators of regulated gaming machines.

64. The gaming system of claim 59, wherein the predetermined computer site is accessible to a plurality of freelance game developers.

65. The gaming system of claim 59, wherein the at least one regulated second version of the game is available for download by a plurality of operators of regulated gaming machines from the predetermined computer site.

66. The gaming system of claim 59, wherein the predetermined computer site is configured to enable uploads of at least one unregulated first versions of games.

67. The gaming system of claim 59, wherein the central management system is further configured to generate the usage metrics of played regulated second versions of the game by:

code signing with a unique certificate each software component of the second outcome-free game portion that is merged into the regulated second versions of the game;

maintaining a list of the unique certificates associated with the second outcome-free game portion developed by at least one freelance developer;

producing an audit log of regulated second versions of the game played on the regulated gaming machine, the audit log containing traces of the unique certificates recorded when each code signed software component is executed, and deriving the usage metrics of played regulated second versions of the game from the audit logs using the traces of the unique code signing certificates.

68. The gaming system of claim 67, wherein the game operator is further configured to maintain an accounting of an amount to pay the at least one freelance game developer according to the derived usage metrics.

69. The gaming system of claim 46, wherein a source of randomization in the at least one unregulated first version of the game is different than a source of randomization in the at least one regulated second version of the game.

70. The gaming system of claim 46, wherein the at least one unregulated first version of the game is configured to store critical meters in a different type of non-volatile storage media than is the at least one regulated second version of the game.

71. The gaming system of claim 46, wherein an executable code of the at least one unregulated first version of the game is configured to store critical meters in a different type of non-volatile storage media than is an executable code of the at least one regulated second version of the game.

72. The gaming system of claim 46, wherein a game software of the at least one unregulated first version of the game is substantially identical to a game software of the at least one regulated second version of the game, except that the at least one regulated second version of the game at least one of (a) allows for wagering using real money, (b) uses a certified source of random outcome, (c) stores critical meters on certified non-volatile memory, (d) provides functionality for player dispute resolution and (e) communicates with a central game management system.

73. The gaming system of claim 46, wherein a source code of the at least one unregulated first version of the game is substantially identical to a source code of the at least one regulated second version of the game, except that the at least one regulated second version of the game at least one of (a) allows for wagering using real money, (b) uses a certified source of random outcome, (c) stores critical meters on certified non-volatile memory, (d) provides functionality for player dispute resolution and (e) communicates with a central game management system.

74. The gaming system of claim 46, wherein each software component of the at least one unregulated first version of the game is code-signed with a unique certificate and wherein the home computing device is configured with associated software restriction policies.

75. The gaming system of claim 46, wherein each software component of the at least one regulated second version of the game is code-signed with a unique certificate and wherein the gaming machine is configured with associated software restriction policies.

76. The gaming system of claim 46, wherein at least one of the first and second repositories includes selectively accessible usage metrics of game play of the at least one unregulated first version of the game played on the home computing device.

77. The gaming system of claim 76, wherein the usage metrics are stored on a predetermined computer site and are selectively available to at least one of an operator of the regulated gaming machine, a developer of the at least one regulated second version of the game, a developer of the first and second outcome-free game portions and a developer of the at least one unregulated first version of the game.

78. The gaming system of claim 76, wherein the predetermined computer site is configured such that the stored usage metrics are selectively available to operators of regulated gaming machines.

79. The gaming system of claim 76, wherein the predetermined computer site is configured such that the stored usage metrics are selectively available to freelance game developers.

80. gaming system of claim 76, wherein the predetermined computer site is configured such that the stored usage metrics are selectively available to players playing on their home computing devices.

81. The gaming system of claim 46, wherein at least one of the first and second repositories includes selectively accessible contact details of a player of the at least one unregulated first version of the game on the home computing device.

82. The gaming system of claim 46, wherein at least one of the first and second repositories includes a selectively accessible preference profile of a player of the at least one unregulated first version of the game on the home computing device.

83. The gaming system of claim 82, wherein the at least one regulated second version of the game is configurable according to the preference profile.

84. The gaming system of claim 46, wherein the first outcome-free game portion of the at least one unregulated first version of the game is modified according to the usage metrics.

85. The gaming system of claim 46, wherein the home computing device is one of a personal computer (PC), a mobile computer and a game console.

86. The gaming system of claim 46, further comprising a database and search engine, the search engine being configured to receive search queries from at least one of the home player, the game operator and the game developer, and to retrieve data from the database.

87. The gaming system of claim 86, wherein the search engine is further configured to crawl the first and second repositories and to generate at least one index of a plurality of documents containing human readable game information for each game and to record the at least one index into the database.

88. The gaming system of claim 86, wherein the database is further configured to record and to make available to the search engine at least one of usage metrics of players, promotions offered by casinos, list of games offered by casinos, advertising offered by freelance developers, attributes of the games available in the gaming exchange and download metrics.

89. A method of distributing a regulated game for regulated gaming machines, comprising the steps of:

providing at least one server and carrying out a first receiving step for receiving an unregulated first version of a game including a first outcome-free game portion and a first outcome-bearing game portion that shows an outcome of the unregulated first version of the game, at least a portion of the first outcome-bearing game portion being configured to be shown during game play in synchronism with and superimposed on or under the first outcome-free game portion, the received unregulated first version of the game being configured to be played without money or configured to enable wagering using only virtual money;

carrying out, using the at least one first server, a first making step to make the received unregulated first version of the game available for download to a plurality of home computing devices;

carrying out, using the at least one first server, a second receiving step for receiving a regulated second version of the game including a second outcome-free game portion and a second outcome-bearing game portion that shows an outcome of the regulated second version of the game, at least a portion of the second outcome-bearing game portion being configured to be shown during game play in synchronism with and superimposed on or under the second outcome-free game portion, the regulated second version of the game being configured to enable wagering using real money, the second outcome-free game portion being substantially identical to the first outcome-free game portion, and carrying out, using the at least one first server, a second making step to make the regulated second version of the game selectively available for download to a regulated gaming machine.

90. The method of claim 89, wherein the regulated second version of the game in the second receiving step is certified by a gaming software certification laboratory.

91. The method of claim 89, wherein the first receiving step is carried out such that source code of the second outcome-free game portion is not submitted to a gaming software certification laboratory.

92. The method of claim 89, wherein the first receiving step is carried out with the unregulated first version of the game being configured to not make use of Internet communication and Internet display technologies to execute and play on the home computing device.

93. The method of claim 92, wherein the Internet communication technologies include at least one of an HTTP Request, an HTTP Reply, a cookie and a Secure Socket Layer (SSL).

94. The method of claim 92, wherein the Internet display technologies include at least one of an Internet browser, HTML, a Java script, a Java applet, a Scriptlet, an ActiveX control, a plug-in, a pop-up and a cookie.

95. The method of claim 89, wherein the first receiving step is carried out with the first outcome-free portion of the unregulated first version of the game being configured to not make use of Internet communication and Internet display technologies to execute and play on the home computing device.

96. The method of claim 89, wherein the second receiving step is carried out with a graphics portion of the unregulated first version of the game being configured to not make use of Internet communication and Internet display technologies to execute and play on the home computing device.

97. The method of claim 89, wherein the first and second receiving steps are carried out such that the first outcome-free game portion of the unregulated first version of the game is identical to the second outcome-free game portion of the regulated second version of the game.

98. The method of claim 89, wherein the first and second receiving steps are carried out such that source code of the first outcome-free game portion of the unregulated first version of the game is substantially identical to source code of the second outcome-free game portion of the regulated second version of the game.

99. The method of claim 89, wherein the first and second receiving steps are carried out such that source code of the first outcome-free game portion of the unregulated first version of the game is identical to source code of the second outcome-free game portion of the regulated second version of the game.

100. The method of claim 89, wherein the first and second receiving steps are carried out such that executable code of the first outcome-free game portion of the unregulated first version of the game is substantially identical to executable code of the second outcome-free game portion of the regulated second version of the game.

101. The method of claim 89, wherein the first and second receiving steps are carried out such that executable code of the first outcome-free game portion of the unregulated first version of the game is identical to executable code of the second outcome-free game portion of the regulated second version of the game.

102. The method of claim 89, further including a step of storing the received unregulated first version of the game in a first repository that is selectively accessible from a predetermined computer site over a computer network and a step of storing the received regulated second version of the game in a second repository that is selectively accessible through the predetermined computer site.

103. The method of claim 102, wherein the predetermined computer site includes an Internet portal.

104. The method of claim 102, further comprising a step of making the predetermined computer site accessible to a plurality of operators of regulated gaming machines.

105. The method of claim 102, further comprising a step of making the predetermined computer site accessible to a plurality of freelance game developers.

106. The method of claim 102, further including the step of making the regulated second version of the game available for download by a plurality of operators of regulated gaming machines from the predetermined computer site.

107. The method of claim 102, further comprising a step of enabling uploads of regulated second versions of games to the predetermined computer site.

108. The method of claim 102, wherein the gaming exchange further comprises a database and a search engine, and wherein the method further includes a step of the search engine receiving search queries from at least one of the home player, the game operator and the game developer and retrieving data from the database.

109. The method of claim 108, wherein the search engine further carries out steps of crawling the first and second repositories, generating at least one index of a plurality of documents found during the crawling step that contain human readable game information for each game, and recording the at least one index into the database.

110. The method of claim 108, further comprising a step of recording in the database, and making available to the search engine, at least one of usage metrics of players, promotions offered by casinos, list of games offered by casinos, advertising offered by freelance developers, attributes of the games available in the gaming exchange and download metrics.

111. The method of claim 89, wherein the first and second receiving steps are carried out such that a source of randomization used in the regulated second version of the game is different than a source of randomization used in the unregulated first version of the game.

112. The method of claim 89, wherein the developing steps are carried out such that the regulated second version of the game is configured to store critical meters in a different type of non-volatile storage media than is the unregulated first version of the game.

113. The method of claim 89, wherein the developing steps are carried out such that an executable code of the regulated second version of the game is configured to store critical meters in a different type of non-volatile storage media than is an executable code of the regulated second version of the game.

114. The method of claim 89, wherein the first and second receiving steps are carried out such that a game software of the regulated second version of the game is substantially identical to a game software of the unregulated first version of the game, except that the regulated second version of the game at least one of (a) allows for wagering using real money, (b) uses a certified source of random outcome, (c) stores critical meters on certified non-volatile memory, (d) provides functionality for player dispute resolution and (e) communicates with a central game management system.

115. The method of claim 89, wherein the first and second receiving steps are carried out such that a source code of the regulated second version of the game is substantially identical to a source code of the unregulated first version of the game, except that the regulated second version of the game at least one of (a) allows for wagering using real money, (b) uses a certified source of random outcome, (c) stores critical meters on certified non-volatile memory, (d) provides functionality for player dispute resolution and (e) communicates with a central game management system.

116. The method of claim 89, wherein the first and second receiving steps are carried out such that each software component of the unregulated first version of the game is code-signed with a unique certificate and wherein the home computing device is configured with associated software restriction policies.

117. The method of claim 89, wherein the first and second receiving steps are carried out such that each software component of the regulated second version of the game is code-signed with a unique certificate and wherein the regulated gaming machines is configured with associated software restriction policies.

118. The method of claim 89, further comprising a step of receiving usage metrics of game play of the unregulated first version of the game played on the home computing device.

119. The method of claim 118, further comprising steps of storing the received usage metrics on a predetermined computer site and making the stored usage metrics available to at least one of an operator of the regulated gaming machine, a developer of the regulated second version of the game, a developer of the first and second outcome-free game portions and a developer of the regulated second version of the game.

120. The method of claim 119, further comprising a step of the operator of the regulated gaming machine selecting the regulated second version of the game for download to the regulated gaming machine in accordance with the usage metrics.

121. The method of claim 119, further comprising a step of configuring the predetermined computer site such that the stored usage metrics are selectively available to operators of regulated gaming machines.

122. The method of claim 119, further comprising a step of configuring the predetermined computer site such that the stored usage metrics are selectively available to freelance game developers.

123. The method of claim 119, further comprising a step of configuring the predetermined computer site such that the stored usage metrics are selectively available to players playing on their home computing devices.

124. The method of claim 89, further comprising a step of receiving contact details of a player of the unregulated first version of the game on the home computing device.

125. The method of claim 89, further comprising a step of receiving a preference profile of a player of the unregulated first version of the game on the home computing device.

126. The method of claim 125, further comprising a step of sending the preference profile of the player of the unregulated first version of the game to the regulated gaming machine.

127. The method of claim 126, further comprising a step of enabling the regulated second version of the game to be configured according to the preference profile.

128. The method of claim 89, further comprising a step of modifying the second outcome-free game portion of the regulated second version of the game in accordance with the usage metrics.

129. The method of claim 89, further comprising a step of sending promotional information to players of the unregulated first version of the game having provided their contact details.

130. The method of claim 89, further comprising a step of sending a notice of availability of the regulated second version of the game on the regulated gaming machine to players of the unregulated first version of the game.

131. The method of claim 89, wherein the home computing device is one of a personal computer (PC), a mobile computer and a game console.

132. The method of claim 89, further comprising steps of:

code signing with a unique certificate each software component of the second outcome-free game portion that is merged into the regulated second versions of the game;

maintaining a list of the unique certificates associated with the second outcome-free game portion developed by at least one freelance developer;

producing an audit log of regulated second versions of the game played on the regulated gaming machine, the audit log containing traces of the unique certificates recorded when each code signed software component is executed, and deriving usage metrics of played regulated second versions of the game from the audit logs using the traces of the unique code signing certificates.

133. The method of claim 132, further comprising a step of maintaining an accounting of an amount to pay the at least one freelance game developer according to the derived usage metrics.

* * * * *